US008100069B2

(12) United States Patent
Asaba et al.

(10) Patent No.: US 8,100,069 B2
(45) Date of Patent: Jan. 24, 2012

(54) CONTROL DEVICE OF SEWING MACHINE

(75) Inventors: Yutaka Asaba, Tokyo (JP); Yasunori Ishii, Tokyo (JP); Sen Mizuhara, Tokyo (JP)

(73) Assignee: Juki Corporation, Chofu-shi, Tokyo (JP)

( * ) Notice: Subject to any disclaimer, the term of this patent is extended or adjusted under 35 U.S.C. 154(b) by 1112 days.

(21) Appl. No.: 11/896,555

(22) Filed: Sep. 4, 2007

(65) Prior Publication Data

US 2008/0066665 A1 Mar. 20, 2008

(30) Foreign Application Priority Data

Sep. 5, 2006 (JP) ..... P.2006-240555

(51) Int. Cl.
*D05B 19/00* (2006.01)

(52) U.S. Cl. ..... 112/447; 112/449

(58) Field of Classification Search ..... 112/65–67, 112/110–115, 235, 446–449, 470.01, 470.03
See application file for complete search history.

(56) References Cited

U.S. PATENT DOCUMENTS 4,181,087 A * 1/1980 Brauch et al. ..... 112/475.25
4,182,249 A * 1/1980 Matumura et al. ..... 112/447
4,216,732 A * 8/1980 Marsh et al. ..... 112/447
4,242,976 A * 1/1981 Beckerman et al. ..... 112/475.25
4,343,249 A * 8/1982 Takenoya et al. ..... 112/456
6,871,606 B2 * 3/2005 Schweizer ..... 112/475.02

FOREIGN PATENT DOCUMENTS

| | | |
|---|---|---|
| JP | 56-15784 | 2/1981 |
| JP | 2-109591 | 4/1990 |
| JP | 3151923 | 9/1993 |
| JP | 8-187382 | 7/1996 |
| JP | 3151923 | 1/2001 |

* cited by examiner

*Primary Examiner* — Nathan Durham
(74) *Attorney, Agent, or Firm* — Drinker Biddle & Reath LLP

(57) ABSTRACT

A control device of a sewing machine includes a pressing member, a pressing frame supported by the pressing member, feed detecting means for detecting a position or a feeding amount of the pressing frame, a feed dog which feeds the workpiece in the cloth feeding direction every stitch in association with the pressing frame, a feeding motor which sets a cloth feeding amount of the feed dog, a storing portion which stores, in every stitch, an error between a target position or a target feeding amount of the pressing frame and a detected position or a detected feeding amount obtained by the feed detecting means, and control means operable, in every stitch, to determine a correction value from the errors in a plurality of stitches which are stored immediately before, and to control the feeding motor to drive with the cloth feeding amount corrected by the correction value.

4 Claims, 17 Drawing Sheets

CONTROL DEVICE OF SEWING MACHINE

The present invention claims priority from Japanese Patent Application No. 2006-240555 filed on Sep. 5, 2006, the entire content of which is incorporated herein by reference.

TECHNICAL FIELD

The present invention relates to a control device of a sewing machine which is operable to carry out a buttonholing sewing with a pressing member having a pressing frame slidable in a cloth feeding direction.

BACKGROUND ART

A domestic sewing machine, which carries out a buttonholing sewing, employs a buttonholing device capable of changing a length of a buttonhole to be formed in accordance with a size of a button (see, e.g., JP 3151923 B2).

As shown in FIG. 16, in a buttonholing device 100, a pressing member 101 having a pressing frame 102 slidable in a cloth feeding direction is attached to a lower end of a pressing bar. A spiral spring 103 is provided in a hollow stopper 102*a* fixed to an upper end surface, in a direction A, of the pressing frame 102. A starting position of the sewing is set such that the pressing member 101 abuts against the stopper 102*a* due to an elastic force of the spiral spring 103 which is constantly being applied thereto.

An end portion, in a direction B, of the pressing frame 102 is provided with a button holding device 104 having a holding portion 104*a* which is slidable in the cloth feeding direction in accordance with a size of a button to be held between a fixed holding portion 104*b* and the holding portion 104*a*.

The pressing member 101 is provided with a potentiometer 105 extending in the cloth feeding direction on an outer side of the pressing frame 102, and the holding portion 104*a* is provided with a detecting portion 106 which contacts with the potentiometer 105. The potentiometer 105 includes a variable resistor. As shown in FIG. 16, when the pressing frame 102 is moved, a position in which the detecting portion 106 and the potentiometer 105 come in contact with each other is changed so that a resistance value changes. Based on a voltage value applied to the resistance thus changing, it is possible to know a displacement amount of the pressing frame 102 (i.e., a sewing length).

When a buttonholing sewing is started, the voltage value applied to the potentiometer 105 at the time of starting is stored in a memory of a control device. The control device drives a sewing machine motor and a needle swinging motor to carry out a bar tack stitching, and then, changes a swinging amount of a needle and drives a cloth feeding motor to carry out a stitching on a left side of a buttonhole. During the sewing operation, the control device decides whether the resistance value of the potentiometer is zero or not. When the control device decides that the resistance value is zero, the control device drives the sewing machine motor and the needle swinging motor to carry out another bar tack stitching, and then, changes the swinging amount of the needle and drives the cloth feeding motor to carry out a stitching on a right side of the buttonhole. The control device decides whether the resistance value of the potentiometer 105 is zero or not. When the control device decides that the resistance value is zero, the control device ends the sewing operation.

FIG. 17 shows another buttonholing device 120 in which a pressing frame 122 is provided slidably in a cloth feeding direction with respect to a pressing member 121 attached to a lower end of a pressing bar of the sewing machine. The pressing frame 122 has a rack 123 provided slidably in the cloth feeding direction. The rack 123 can be moved so as be adjusted to a scale (not shown) formed on the pressing frame 122, and can be fixed to the pressing frame 122 by fastening a knob 124 provided on the rack 123. A rotary potentiometer 126 is supported on the pressing member 121, and includes a pinion (a gear) 125 engaging with the rack 123 (see, e.g., JP 56-015784 A).

When feeding a cloth in the buttonholing device 120, the pressing frame 122 slides in a cloth feeding direction with respect to the pressing member 121 together with the cloth. The pinion 125 engaging with the rack 123 is rotated, therefore, and a moving amount of the pressing frame 122 is detected by the potentiometer 126 from a rotation amount of the pinion 125.

In addition, an error of a cloth feeding amount is detected by the potentiometer 126 in every stitch, and the cloth feeding amount is corrected in every stitch based thereon. Namely, in the buttonholing device 120, the potentiometer 126 is used to detect a target distance (i.e., a length of a buttonhole) and to detect a feeding error in every stitch.

However, in the buttonholing device 100 disclosed in JP 3151923 B2, only a reaching to a target position is monitored by the potentiometer. Thus, a reduction in a pitch from the set pitch cannot be recognized when a smooth cloth feeding is disturbed, e.g., by a step portion on a middle portion of the cloth. As a result, there is a problem that an unstableness of the pitch or a feeding jam is generated.

Further, in a circular arc section of an eyelet buttonholing sewing, the needle is located in accordance with predetermined X-Y position coordinate data. Therefore, the monitoring operation by the potentiometer is not carried out. Accordingly, there is again a problem that an unstableness of the pitch or a feeding jam is generated.

In the buttonholing device 120 disclosed in JP 56-015784 A, a feeding error is obtained in every stitch, and a feeding correction is carried out in every subsequent stitch. Therefore, it is possible to perform a correction to eliminate a pitch error in every stitch which may be caused by the generation of a feeding hindrance due to a step. However, because an error in the previous stitch is directly corrected in the subsequent stitch, the feed in the subsequent stitch is greatly influenced in a case in which an error is accidentally caused only in one stitch or in a case in which a noise is generated in the detection of the potentiometer. Thus, in some cases, a great error is generated as a result so that the sewing operation becomes unstable.

SUMMARY OF INVENTION

One or more embodiments of the invention provide a control device of a sewing machine which is operable to suppress an unstableness of a pitch and to form an accurate and stable seam.

According to a first aspect of the invention, a control device of a sewing machine comprises:

a pressing member (21) which is detachably attached to a lower end of a pressing bar of the sewing machine;

a pressing frame (22) which is supported by the pressing member so as to be movable in a cloth feeding direction of a workpiece and which holds the workpiece (W);

feed detecting means (24) for detecting a position or a feeding amount of the pressing frame in the cloth feeding direction with respect to the pressing member;

a feed dog (5) which holds the workpiece between the feed dog and the pressing frame and which feeds the workpiece in the cloth feeding direction every stitch;

a feeding motor (48) which sets a cloth feeding amount of the feed dog;

a storing portion (32) which obtains and stores, in every stitch, an error between a target position or a target feeding amount of the pressing frame in the cloth feeding direction and a detected position or a detected feeding amount obtained by the feed detecting means; and control means (3) operable, in every stitch, to determine a correction value from the errors in a plurality of stitches which are stored immediately before and to control the feeding motor to drive with the cloth feeding amount corrected by the correction value.

According to a second aspect of the invention, the control means may be further operable to obtain the correction value separately in a forward feeding direction and a reverse feeding direction, wherein the control means may control the feeding motor, in every stitch, based on the correction value in the forward feeding direction when the cloth feeding is carried out in the forward feeding direction, and based on the correction value in the reverse feeding direction when the cloth feeding is carried out in the reverse feeding direction.

According to a third aspect of the invention, a control device of a sewing machine, in which a sewing is carried out in accordance with sewing data including a combination of a tacking sewing for forming a seam in a form of a line with a certain pitch and a zigzag sewing for forming a seam swinging over alternately, comprises:

a needle swinging motor (46) which swings a needle in a direction orthogonal to a cloth feeding direction;

a pressing member (21) which is detachably attached to a lower end of a pressing bar of the sewing machine;

a pressing frame (22) which is supported by the pressing member so as to be movable in the cloth feeding direction of a workpiece (W) and which holds the workpiece;

feed detecting means (24) for detecting a position or a feeding amount of the pressing frame in the cloth feeding direction with respect to the pressing member;

a feed dog (4) which holds the workpiece between the feed dog and the pressing frame and which feeds the workpiece in the cloth feeding direction every stitch;

a feeding motor (48) which sets a cloth feeding amount of the feed dog;

a storing portion (32) which obtains and stores, in every stitch, an error between a target position or a target feeding amount of the pressing frame in the cloth feeding direction and a detected position or a detected feeding amount obtained by the feed detecting means;

control means (3) operable, in every stitch, to determine a correction value from the errors in a plurality of stitches which are stored immediately before and to control the feeding motor to drive with the cloth feeding amount corrected by the correction value; and a switching control portion (3) operable to determine whether or not a distance to a target position, at which a sewing is switched from the tacking sewing to the zigzag sewing, is equal to or smaller than one pitch in accordance with a detection of the feed detecting means, wherein if the distance is equal to or smaller than the one pitch, the switching control portion controls the needle before reaching at the switching target position.

According to a fourth aspect of the invention, the control means may be further operable to obtain the correction value separately in a forward feeding direction and a reverse feeding direction, wherein the control means may control the feeding motor, in every stitch, based on the correction value in the forward feeding direction when the cloth feeding is carried out in the forward feeding direction, and based on the correction value in the reverse feeding direction when the cloth feeding is carried out in the reverse feeding direction.

According to the first and third aspects of the invention, the pressing frame and the workpiece are fed by the operation of the feed dog based on the target position or the target feeding amount every stitch in the sewing operation, and an actual position or feeding amount in that case is detected by the feed detecting means. The error between the detecting position or the detected feeding amount and the target position or the target feeding amount is obtained by the feeding control device and is stored accumulatively. When the errors corresponding to a plurality of stitches which is predetermined is stored, the correction value is calculated therefrom and the cloth feeding amount is corrected by the correction value so that the control of the feeding motor is reflected. In each feed, subsequently, the correction value is obtained from the error in the last stitch and the cloth feeding amount is corrected so that the feeding operation is carried out.

Moreover, the sewing control includes the case in which the target position or the target feeding amount is determined every stitch in order to sew a predetermined sewing pattern and the case in which the cloth is continuously fed in a certain target feeding amount. The control for correcting the feeding amount may be applied to both of them.

Furthermore, the correction value may be a correction value to be added or subtracted with respect to the cloth feeding amount or may have a correction ratio by which the cloth feeding amount is multiplied. In any case, the correction value may be an error value of a plurality of stitches or an average value of an error ratio, and the average value may be obtained by weighting a nearer value.

By the structure, according to the first and third aspects of the invention, the correction value is obtained, in each of the stitches, from the detecting positions or the detected feeding amounts in the several previous stitches to modify the cloth feeding amount. Therefore, the cloth feeding amount is corrected every stitch, and the generation of a variation can be suppressed and sewing quality can be enhanced.

As compared with the case in which the feeding amount is corrected based on only an error in the previous stitch (a single stitch), it is possible to avoid the correction by which the error is reflected sensitively. For example, it is possible to reduce the influence in the case in which an error is increased by the accidental generation of a disturbance on the feed in a previous stitch or the influence of an error made by a noise in the detection. Thus, it is possible to carry out a stable sewing operation.

According to the second and fourth aspects of the invention, the control means distinguishes the detected cloth feeding amounts in the forward direction and the reverse direction and separately calculates the correction values, and corrects the feeding amount by employing the correction value in the forward direction if the feed in the forward direction is carried out to reach the target position, and by employing the correction value in the reverse direction if the feed in the reverse direction is carried out to reach the target position.

In many cases, the error is not uniformly caused in the forward feeding direction and the reverse direction by various causes, for example, a structure of a mechanism for transmitting a power to the feed dog or the case in which the pressing frame is biased in one direction. Also in those cases, according to the second and fourth aspects of the invention, the separate correction values are obtained in the forward direction and the reverse direction. Therefore, it is possible to eliminate the error in the forward direction and the error in the reverse direction respectively and to carry out the feed with high precision every stitch. In addition, it is possible to suppress a variation in a sewing pitch and to further enhance sewing quality.

According to the third aspect of the invention, in the sewing operation, a linear sewing operation is ended and a transition to a zigzag sewing operation is carried out when a linear seam requires one residual pitch or less to the target position. Therefore, it is possible to prevent the seam from getting out of the target position. Accordingly, in a case in which the linear sewing operation is utilized as the tacking operation and the zigzag sewing operation is carried out with an overlap thereover, for example, it is possible to prevent the tacking seam from getting out of the range of the zigzag seam, thereby enhancing the sewing quality.

DETAILED DESCRIPTION

Overall Configuration of Sewing Machine

Figure 1:
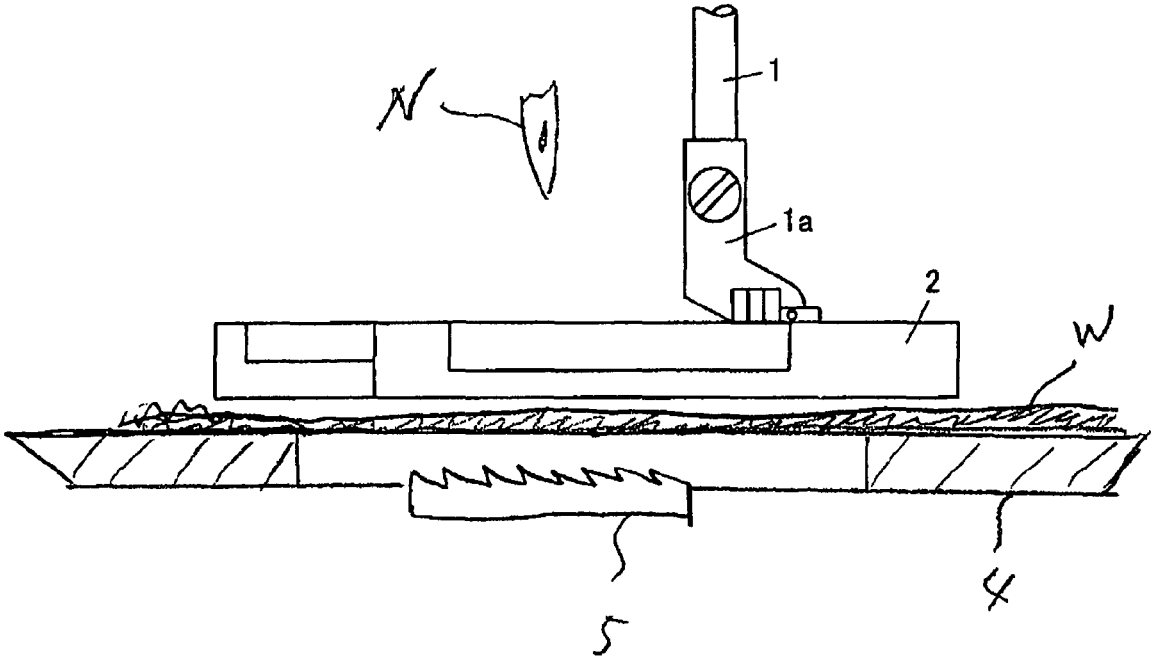
FIG. 1 is a schematic side view of a buttonholing device attached to a pressing bar.

Hereinafter, sewing machines according to exemplary embodiments of the invention will be explained with reference to the drawings. In the following exemplary embodiments, sewing machines capable of performing buttonholing will be described as an example.

As shown in FIGS. 1 to 4, a sewing machine 10 includes a needle vertical moving mechanism (not shown), a feeding mechanism (not shown), a buttonholing device 2, and a control device 3 which controls an operation of each of the components. The needle vertical moving mechanism includes a sewing machine motor 44 as a driving source, and moves a needle N in a vertical direction, and swings the needle N in a direction orthogonal to a cloth feeding direction. The feeding mechanism includes a feed dog 5 which is disposed below a throat plate 4 and moves in the cloth feeding direction to feed a workpiece W and a pressing frame 22 in the cloth feeding direction, and a feeding step motor 48 (a feeding motor) for adjusting a cloth feeding amount of the feed dog 5. The buttonholing device 2 holds a cloth (the workpiece W), and feeds the cloth forwardly or rearwardly along the cloth feeding direction by cooperating with the feeding mechanism.

(Needle Vertical Moving Mechanism)

The needle vertical moving mechanism includes an upper shaft (not shown) which is rotated by the sewing machine motor 44, a power transmitting mechanism (not shown) having a cam or a crank to convert a rotating force of the upper shaft into a reciprocating driving force in the vertical direction and to apply the reciprocating driving force to a needle bar holding the needle N, and a needle swinging step motor 46 (a needle swinging motor) which moves the needle bar in a needle swinging direction. Because these structures are well known in a sewing machine which vertically moves a needle while swinging the needle, detailed descriptions thereof will be omitted.

This needle vertical moving and swinging mechanism swings the needle in a direction orthogonal to the cloth feeding direction and parallel to an upper surface of the throat plate 4.

(Feeding Mechanism)

The feeding mechanism includes the feed dog 5 which carries out a feeding motion below the throat plate 4 interlockingly with a lower shaft (not shown) rotated by the sewing machine motor 44. A reciprocating amount and a phase of the feed dog 5 in the cloth feeding direction can be changed and adjusted by using a moving member, such as a square piece for changing a reciprocating direction, or a four-bar linking mechanism having a well-known structure. A drive source of such changing and adjusting is the feeding step motor 48 (the feeding motor).

(Buttonholing Device)

As shown in FIG. 1, a pressing bar 1, which is pushed downward by means of a spring, is supported at a lower tip portion of an arm portion of a sewing machine frame (not shown) so as to be movable in a vertical direction. A pressing holder 1*a* is provided on a lower end of the pressing bar 1, and the buttonholing device 2 which presses the cloth (the workpiece) is provided on the pressing holder 1*a*.

The buttonholing device 2 is placed such that a lower surface thereof is opposed to the upper surface of the throat plate 4 on which the cloth is mounted.

Figure 2:
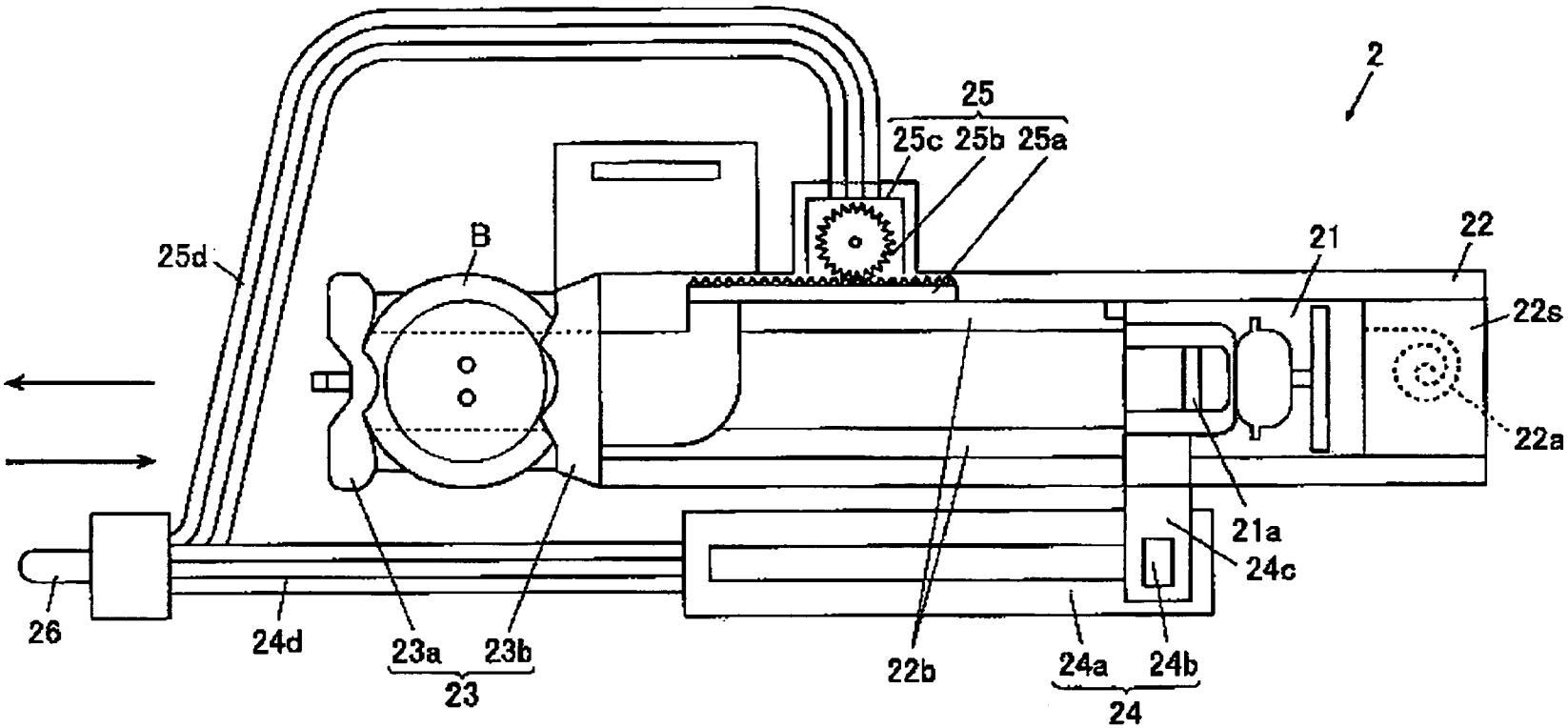
FIG. 2 is a schematic plan view of the buttonholing device.
Figure 3:
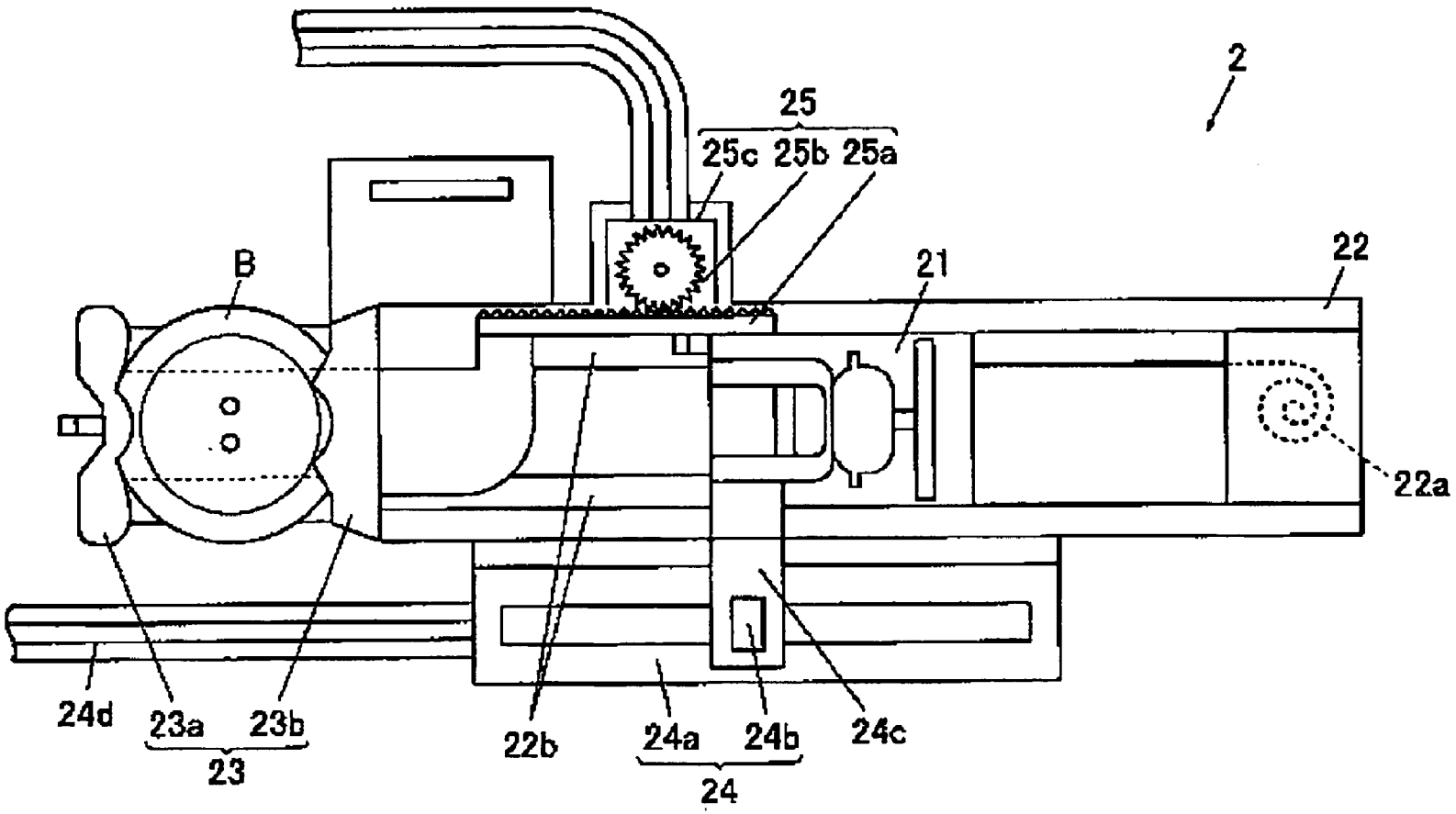
FIG. 3 is a schematic plan view of the buttonholing device when being used.

As shown in FIG. 2, the buttonholing device 2 includes a pressing member 21 which is attached to the pressing holder 1*a* provided on the lower end of the pressing bar 1, the pressing frame 22 which is slidably held by the pressing member 21 and presses the cloth from above while moving in accordance with the cloth feeding during a sewing operation, a button holding device 23 provided on an upper surface of the pressing frame 22, a position detecting device 24 (feed detecting means) which continuously detects a displacement amount from a sewing start position during the buttonholing sewing, and a button diameter detecting device 25 to be detecting means for detecting a diameter of a button held by the button holding device 23.

(Pressing Member)

As shown in FIG. 2, an upper surface of the pressing member 21 is provided with a coupling bar 21*a* for the pressing holder 1*a* on the lower end of the pressing bar 1 to hold and couple the pressing member 21. The pressing holder 1*a* is provided with holding means capable of being switched between hold and release of the coupling bar 21*a* by a manual operation. Accordingly, the pressing member 21 is attachable and detachable with respect to the pressing bar by holding and releasing the coupling bar 21*a* and the pressing holder 1*a*.

The pressing member 21 is coupled to a spiral spring 22*a* provided on one end of the pressing frame 22. The pressing member 21 is biased so as to abut against a stopper 22s provided on the end of the pressing frame 22 unless the pressing frame 22 is moved by an external force. A direction in which the spiral spring 22*a* pulls the pressing member 21 toward the stopper 22s is a rearward feeding direction F of the cloth feeding (see FIGS. 5 and 6A), and a direction in which the pressing member 21 is separated from the stopper 22s against the spiral spring 22*a* is a forward feeding direction of the cloth feeding.

(Pressing Frame)

As shown in FIG. 2, the pressing frame 22 is formed from a plate member having a rectangular shape in which a longitudinal direction is set along the cloth feeding direction, and guides 22*b* formed along the longitudinal direction for fitting the pressing member 21 therein such that the pressing frame 22 is slidable with respect to the pressing member 21. The spiral spring 22*a* is provided inside the stopper 22s disposed on the end of the pressing frame 22, and biases the stopper 22s of the pressing frame 22 toward the pressing member 21. Due to the spiral spring 22*a*, the stopper 22s provided on the pressing frame 22 is brought into an abutting state against the pressing member 21 before starting the sewing operation.

(Position Detecting Device)

As shown in FIG. 2, the position detecting device 24 is constituted as a so-called slide volume, and includes a variable resistor 24*a* (a sliding base) which is formed in the cloth feeding direction, and is fixed to the pressing frame 22 to move in accordance with a movement of the pressing frame 22 in the cloth feeding direction, and a volume lever 24*b* (a sliding member) which is connected to the pressing member 21 and relatively slides with respect to the variable resistor 24*a* in the cloth feeding direction.

The variable resistor 24*a* is provided on the outer side of the pressing frame 22 parallel to the longitudinal direction of the pressing frame 22, i.e., along the cloth feeding direction. When the variable resistor 24*a* moves in the cloth feeding direction, the volume lever 24*b* relatively slides in the cloth feeding direction over the variable resistor 24*a*, whereby a resistance value of the variable resistor 24*a* is changed in accordance with a position of the volume lever 24*b* on the variable resistor 24*a*.

The volume lever 24*b* is connected to the pressing member 21 via a connecting lever 24*c*. More specifically, because the pressing member 21 is fixed to the pressing bar 1, the volume lever 24*b* is moved relative to the variable resistor 24*a* when the pressing frame 22 is moved in the cloth feeding direction, whereby that the resistance value is changed depending on a feeding amount of the pressing frame 22 and so that a detected voltage value changes. The pressing frame 22 is moved in accordance with the feeding operation of the sewing operation. Therefore, it is possible to measure a position of the pressing frame 22 in the cloth feeding direction, i.e., a sewing length of the buttonholing operation based on the detected voltage value.

A lead wire 24*d* is connected to the variable resistor 24*a* so that a voltage value applied to the variable resistor 24*a* can be detected by the control device 3 (which will be described below). The control device 3 can detect, at any time, the position of the pressing frame 22 in the cloth feeding direction from a state in which the pressing frame 22 is placed in a sewing start position with respect to the pressing member 21, i.e., from a state in which the end of the pressing frame 22 abuts against the pressing member 21.

(Button Holding Device)

As shown in FIG. 2, the button holding device 23 includes a fixed portion 23*b* fixed to the other end of the pressing frame 22 and holds a part of an outer periphery of a button B, and a sliding portion 23*a* (a moving portion) which is disposed so as to oppose to the fixed portion 23*b* and to be movable with respect to the pressing frame 22. The button is held between the sliding portion 23*a* and the fixed portion 23*b*. The fixed portion 23*b* and the sliding portion 23*a* holds respective end portions on a diameter of the button B. Although the sliding portion 23*a* is movable and a position thereof is adjustable with respect to the pressing frame 22, it stays at a certain position unless an external force is applied. The sliding portion 23*a* can be moved so as to correspond to a size of the button so that the button is held in a stable state.

(Button Diameter Detecting Device)

As shown in FIG. 2, the button diameter detecting device 25 includes a rack 25*a* fixed and provided onto the sliding portion 23*a* of the button holding device 23, a pinion 25*b* engaging with the rack 25*a*, a rotary potentiometer 25*c* supported on the pressing frame 22, and a lead wire 25*d* via which an output signal is sent from the potentiometer 25*c* to the control device 3.

The pinion 25*b* is provided on a rotating amount detecting shaft of the potentiometer 25*c*. When the sliding portion 23*a* is moved, the rotating amount detecting shaft of the potentiometer 25*c* is rotated through the rack 25*a* and the pinion 25*b* so that a detection signal corresponding to a moving amount of the sliding portion 23*a* can be output to the control device 3.

The lead wire 24*d* connected to the variable resistor 24*a* and the lead wire 25*d* connected to the detecting portion 25*a* are bundled, and a connector 26 is provided at tip end portions thereof. The connector 26 can be attached or detached with respect to the control device 3.

(Control Device)

The control device 3 is provided in a sewing machine body. The control device 3 controls, in accordance with a predetermined sewing program, the driving operations of the sewing machine motor 44, the needle swinging step motor 46 and the feeding step motor 48 which will be described below.

Figure 4:
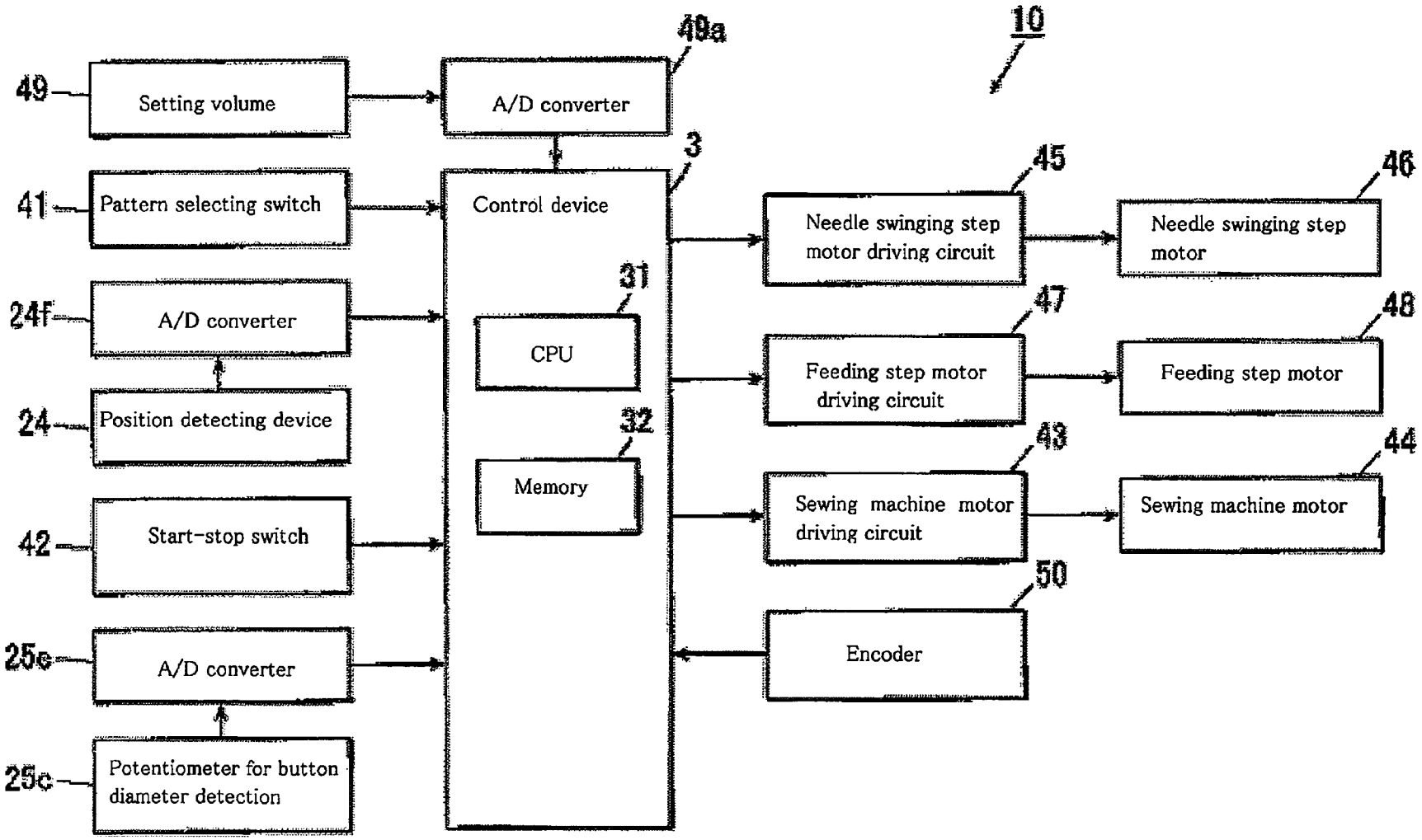
FIG. 4 is a block diagram showing a structure of a sewing machine.

As shown in FIG. 4, the control device 3 includes a CPU 31 which executes the sewing program, and a memory 32 (a storing portion) in which a sewing program and sewing data on a sewing pattern (e.g., an eyelet sewing pattern) are stored.

A pattern selecting switch 41, from which a sewing pattern is selected, and a start-stop switch 42, from which a start or a stop of a sewing operation is input, are connected to the control device 3. Moreover, a setting volume 49, from which a feeding pitch and a needle swinging width in the sewing operation are respectively input, is connected to the control device 3 through an A/D converter 49*a*. These switches and the volume are arranged on a surface of the sewing machine body.

A sewing machine motor driving circuit 43 is connected to the control device 3, and the sewing machine motor 44 is connected to the sewing machine motor driving circuit 43.

An encoder 50 for detecting a shaft angle of an upper shaft, which rotated by the sewing machine motor 44, is connected to the control device 3.

A needle swinging step motor driving circuit 45 is connected to the control device 3, and the needle swinging step motor 46 is connected to the needle swinging step motor driving circuit 45.

A feeding step motor driving circuit 47 is connected to the control device 3, and the feeding step motor 48 is connected to the feeding step motor driving circuit 47.

The potentiometer 25*c* is connected to the control device 3 through an A/D converter 25*e*, and a detection output of the potentiometer 25*c* is input to the control device 3.

The position detecting device 24 is connected to the control device 3 through an A/D converter 24*f*, and the detected voltage applied to the variable resistor 24*a* (a detection output) is input to the control device 3.

(Buttonholing Sewing)

Figure 5:
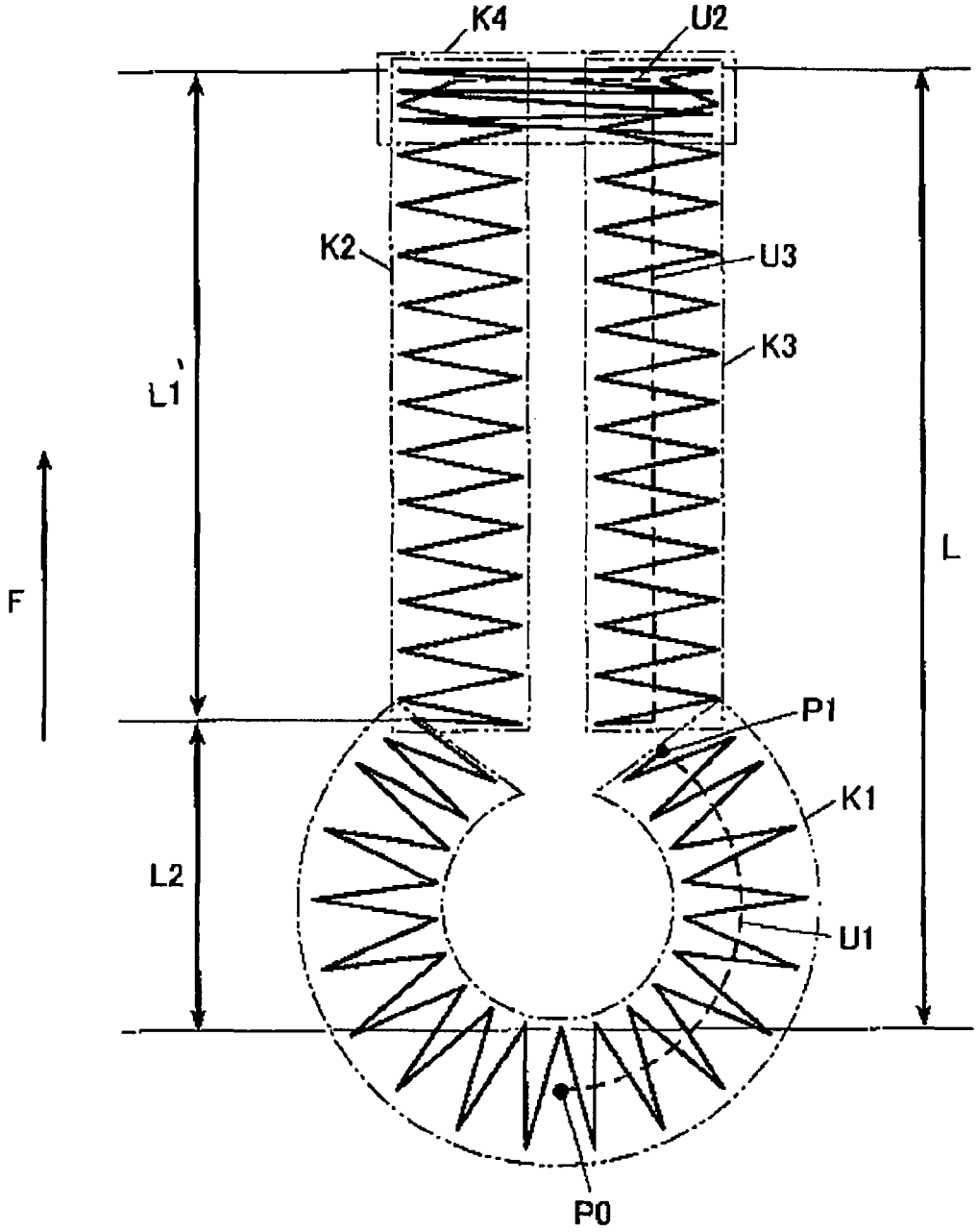
FIG. 5 is an explanatory view showing a structure of stitching sections in an eyelet buttonholing.
Figure 6A:
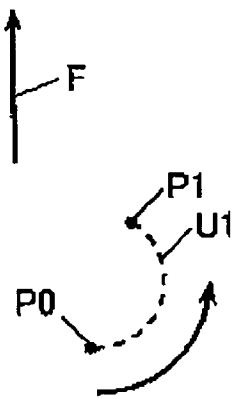
FIGS. 6A to 6E are explanatory views, each showing a stitching process of the eyelet buttonholing in order.
Figure 6B:
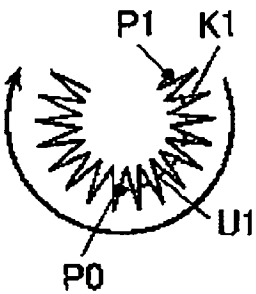
Figure 6C:
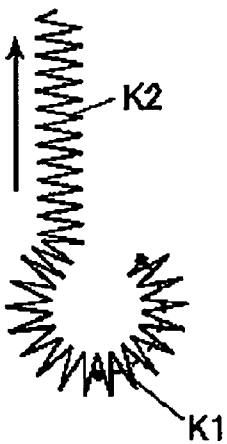
Figure 6D:
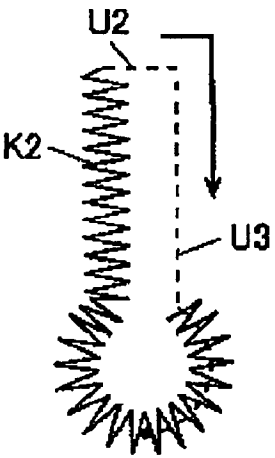
Figure 6E:
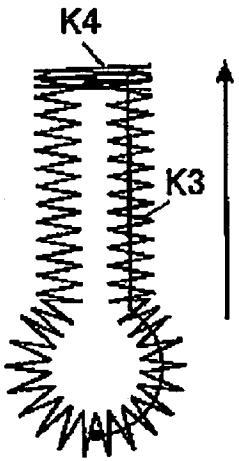

Next, a buttonholing sewing will be described. Description will be given by taking an eyelet buttonholing sewing as one example of a sewing pattern. FIG. 5 is an explanatory view showing a structure of respective stitching sections in an eyelet buttonholing, and FIGS. 6A to 6E are explanatory views, each showing a stitching process of the eyelet buttonholing. In FIGS. 5 and 6A, the arrow F indicates a reverse feeding direction in the cloth feeding.

As shown in FIG. 5 and FIGS. 6A to 6E, the eyelet buttonholing sewing is executed in order of a tacking section U1, an annular section K1, a left side stitching section K2, a tacking section U2, a tacking section U3, a right side stitching section K3 and a bar tacking section K4, starting from a sewing start position P0.

In the tacking sections U1, U2 and U3, a stitching is carried out such that a series of stitches draws a locus in a line. In the tacking section U1, similarly to the annular section K1 which will be described below, an arcuate stitching is carried out so as to move the cloth from the sewing start position P0 to a first stitch position of the annular section K1. The stitching is carried out in accordance with pattern data in which a position in the cloth feeding direction and a needle swinging amount are predetermined in order for each one of the stitches. A plurality of pattern data for various diameters is prepared in the memory 32. When the pattern data of the annular section K1 having a diameter suitable for a buttonhole length L are selected, pattern data of the tacking section U1 corresponding thereto are selected at the same time.

In the tacking section U2, a stitching is carried out straight in a transverse direction from a final stitch position of the left side stitching section K2 to a first stitch position of the tacking section U3, and a stitching length thereof corresponds to a needle swinging length in the bar tacking section K4 which will be described below. The stitching length of the tacking section U2 is calculated simultaneously with the needle swinging length.

In the tacking section U3, a stitching is carried out straight in the forward direction in the cloth feeding from a final stitch position of the tacking section U2 to a first stitch position of the right side stitching section K3, and a stitching length thereof is equal to the sewing lengths of the side stitching sections K2 and K3 which will be described below. Thus the stitching length of the tacking section U3 is calculated simultaneously with the sewing lengths of the side stitching sections K2 and K3.

Over each of the tacking sections U1, U2 and U3, the stitching operations for the annular section K1, the bar tacking section K4 and the right side stitching section K3 are carried out, whereby seams thereof are hidden on a surface.

In the left side stitching section K2 and the right side stitching section K3, a zigzag stitch is formed in the reverse feeding direction F while swinging the needle. The cloth is fed in a reverse direction at a certain pitch every stitch, and at the same time, a needle swinging direction is alternately switched with a certain needle swinging width every stitch. The pitch and the needle swinging width are preset by inputting numeric values from the setting switch 49.

The sewing length L1 of the left side stitching section K2 and the right side stitching section K3 is set in accordance with the buttonhole length L which is determined based on the button diameter detected by the button diameter detecting device 25.

The cloth is fed in the reverse feeding direction F in both the left side stitching section K2 and the right side stitching section K3. This is to eliminate a difference in respective right and left pitches which might be caused when the right and left sewing operation is carried out in opposite directions with each other. The tacking section U3 is for carrying out the right side stitching section K3 in the same reverse feeding direction F after the left side stitching section K2.

Figure 7:
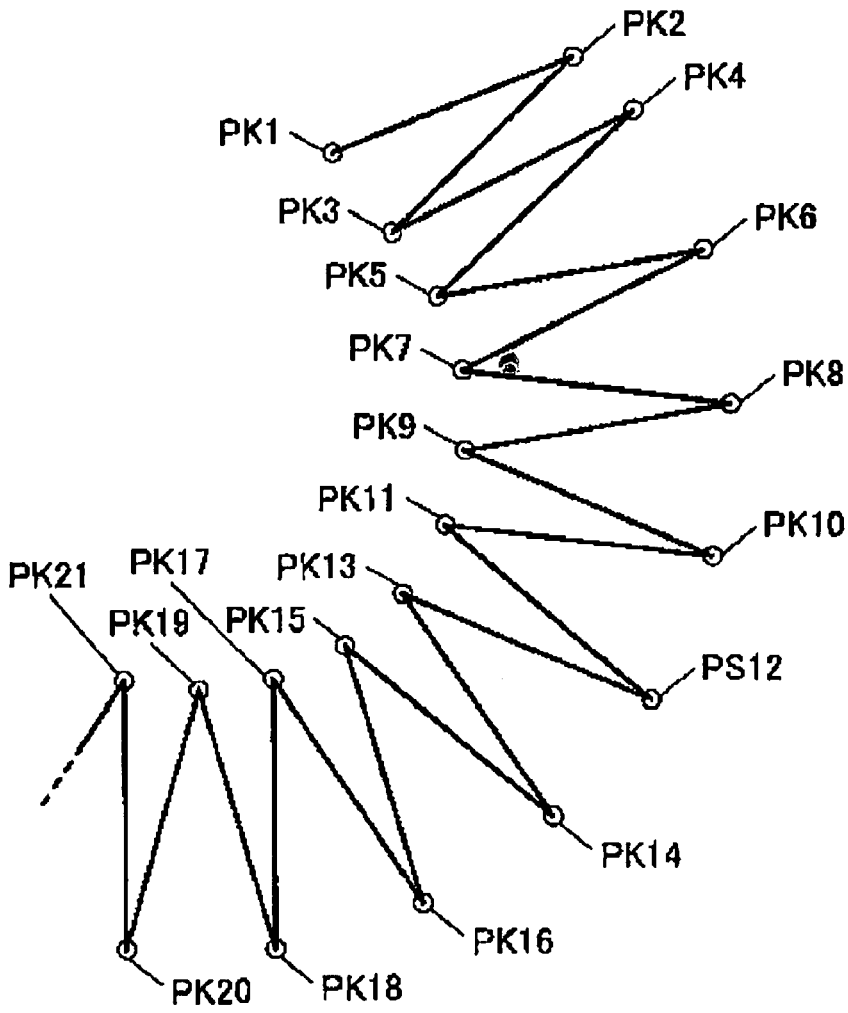
FIG. 7 is an enlarged explanatory view showing an annular section in the eyelet buttonholing.

In the annular section K1, the stitching is carried out so as to follow the stitch points of the zigzag stitching along an annular (more specifically, an arcuate) locus. However, with the structure of the sewing machine 10, it is difficult to feed the cloth along the arcuate locus with respect to the swinging needle N or to turn the swinging needle N. Therefore, the needle swing and the cloth feed are controlled in accordance with predetermined pattern data in which positions in the cloth feeding direction and needle swinging amounts are predetermined sequentially for each of the stitches to be formed, thereby carrying out stitching substantially on the stitch points of the zigzag stitching along the arcuate locus. FIG. 7 is an enlarged view showing a part of the annular section K1.

In the pattern data, a needle swinging amount and a cloth feeding amount is defined for all the stitch points in the annular section K1, e.g., referring to stitch points PK1, PK2, PK3 in FIG. 7, a needle swinging amount and a cloth feeding amount for a movement from PK1 to PK2, a needle swinging amount and a cloth feeding amount for a movement from PK2 to PK3, a needle swinging amount and a cloth feeding amount for a movement from PK3 to PK4, are defined.

Moreover, a plurality of pattern data for different diameters of the annular section K1 are prestored in the memory 32. The CPU 31 selects pattern data of the annular section K1 for a suitable diameter that corresponds to the buttonhole length L determined from the button diameter detected by the button diameter detecting device 25.

For the buttonhole length L, a value obtained by adding a predetermined length to the detected button diameter is used (e.g., 2 mm is added to the button diameter). A value of an inside diameter L2 of the annular section K1 is also set to the pattern data. When the pattern data of the annular section K1 are selected, the sewing length L1 of the left side stitching section K2 and the right side stitching section K3 is calculated by subtracting the inside diameter L2 included in the data from L.

When the sewing operations in the left and right side stitching sections K2 and K3 are completed, a stitching is carried out in the bar tacking section K4 by swinging the needle several times across respective end portions of the side stitching sections K2 and K3. The bar tacking is for strengthening the end portion of the buttonhole. When the needle swinging width of the side stitching sections K2 and K3 are input and set, the needle swinging width of the bar tacking is calculated in the CPU 31 to be a little more than a double of the needle swinging width of the side stitching sections K2 and K3.

(Feedback Control)

During the sewing operation, positions in the cloth feeding direction is detected by the position detecting device 24 for a second stitch and succeeding stitches after a sewing start (because a first stitch is at the origin position P0, the needle swing and the cloth feed are not carried out).

In the sewing operation, the CPU 31 (a feeding control portion) executes a control in accordance with a processing of a feeding feedback control program stored in the memory 32.

More specifically, the CPU 31 carries out a control by which a predetermined target position or a predetermined target feeding amount in the cloth feeding direction is obtained in each of the stitches, an error in an actual feeding amount based on the detected position acquired by the position detecting device 24 is obtained, a correction value is calculated for each of the stitches from the errors in the previous five stitches, and the cloth feeding amount with respect to the target position is corrected with the correction value, thereby driving the feeding motor.

More specifically, when a position xi of the pressing frame 22 in the cloth feeding direction is detected by the position detecting device 24 in each of the stitches, the CPU 31 calculates an actual feeding amount of the pressing frame 22 from a difference from a previous position xi-1 of the pressing frame 22. Then, an error Ai is calculated by comparing with a target feeding amount to a current target position, and the error Ai is divided by the target feeding amount to calculate an error ratio $\alpha i$. The error ratio $\alpha i$ is sequentially stored in the memory 32 (i=1, 2, 3, . . . ).

When error ratios $\alpha$1 to $\alpha$5 corresponding to five stitches are stored, they are averaged to obtain an average error ratio $\alpha$ave, and a feeding amount to a next target position is multiplied by the average error ratio $\alpha$ave and is thus corrected, and the feeding amount is controlled to be the multiplied value. Thereafter, every time a new error ratio $\alpha$6 is obtained, the average error ratio $\alpha$ave is obtained with respect to $\alpha$2 to $\alpha$6, and the feeding amount is sequentially corrected.

(Operation Control in Buttonholing Sewing)

Figure 8:
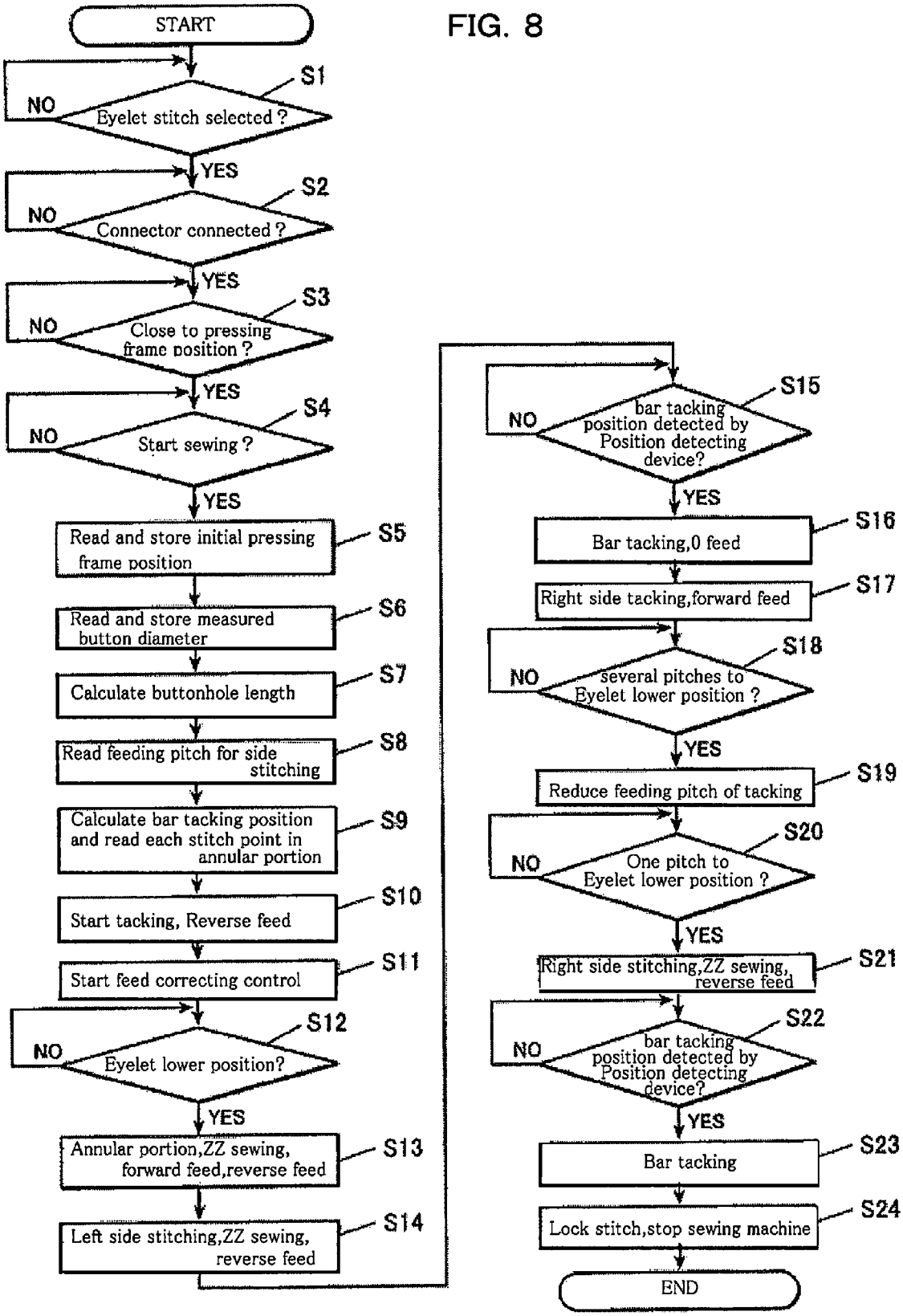
FIG. 8 is a flowchart showing an entire processing of the eyelet buttonholing.

Next, an operation control in the buttonholing sewing will be described with reference to FIGS. 6A to 6E and FIG. 8. FIG. 8 is a flowchart showing a control in an eyelet buttonholing sewing. In the buttonholing sewing, it is assumed that a button B to be inserted through a buttonhole is held between the fixed portion 23*b* and the sliding portion 23*a* of the button holding device 23 in advance and is kept in that state.

First, the CPU 31 decides whether or not an eyelet stitch is selected as a sewing pattern (Step S1).

If the CPU 31 decides that the eyelet stitch is selected (Step S1: YES), it decides whether or not the connector 26 is inserted into a predetermined portion of the sewing machine body (Step S2).

If the CPU 31 decides that the connector 26 is inserted into the sewing machine body (Step S2: YES), it decides whether or not the volume lever 24*b* is placed at the origin position (the position shown in FIG. 2) of the variable resistor 24*a* or in the vicinity thereof, i.e., whether or not the stopper 22s of the pressing frame 22 and the pressing member 21 are in an abutting state or in the vicinity thereof (Step S3).

If the CPU 31 decides that the volume lever 24*b* is placed at the origin position of the variable resistor 24*a* or in the vicinity thereof (Step S3: YES), it decides whether or not the start-stop switch 42 is pressed (Step S4).

If the CPU 31 decides that the start-stop switch 42 is pressed (Step S4 YES), it stores an initial position (an origin position or a position close to the origin position) in the memory 32 through the output of the position detecting device 24 (Step S5).

Further, the CPU 31 reads an outside diameter of the button from the output of the potentiometer 25*c* of the button diameter detecting device 25, and stores it in the memory 32 (Step S6). When the outside diameter of the button is detected, then, a predetermined length is added to calculate the buttonhole length L, and the buttonhole length L is stored in the memory 32 (Step S7).

Subsequently, the CPU 31 reads input set values of a feeding pitch and a needle swinging width in the side stitching sections K2 and K3 from the output of the setting volume 49, and stores them in the memory 32 (Step S8).

Furthermore, the CPU 31 selects the pattern data of the annular section K1 from the calculated buttonhole length L, calculates the sewing length L1 of the side stitching sections K2 and K3, and calculates the stitch points and a width of the bar tacking section K4, thereby calculating the needle swinging width and the feeding position in all of the stitch points in the eyelet buttonholing stitch (Step S9).

Next, the CPU 31 starts to drive the sewing machine motor 44 to carry out a needle penetration of a first stitch at the sewing start position P0, and switches the feeding step motor 48 into the reverse feeding direction to start the sewing operation in the tacking section U1 (FIG. 6A: Step S10). Then, the feedback control for a cloth feeding is executed from the first stitch (Step S1). The details thereof will be described later.

Subsequently, the CPU 31 decides, through the position detecting device 24, whether or not the cloth reaches an eyelet lower position P1 which is a first stitch in the annular section K1 (Step S12). If the cloth reaches the eyelet lower position P1, a zigzag sewing operation (a ZZ sewing operation) is executed in accordance with the pattern data of the annular section K1. At this time, the needle swinging step motor 46 is driven by a needle swinging amount determined for each of the stitches based on the pattern data and the feeding step motor 48 is driven to obtain a forward feeding amount or a reverse feeding amount which is determined for each of the stitches (FIG. 6B: Step S13).

When all the stitches determined in the pattern data of the annular section K1 are completed, the CPU 31 executes the zigzag sewing operation (the ZZ sewing operation) in the left side stitching section K2. At this time, the needle swinging step motor 46 is driven based on a needle swinging amount input from the setting volume 49, and the feeding step motor 48 is driven in reverse feed based on a pitch input from the setting volume 49 (FIG. 6B: Step S14).

When a bar tacking position (a position having the sewing length L1 from the sewing start position of the side sewing section K2 or a position having the buttonhole length L from the origin point P0) is detected by the position detecting device 24 (Step S15), the stitching in the tacking section U2 is carried out. In the section U2, the operation control of the needle swinging step motor 46 is carried out in such a manner that the cloth feeding amount is set to be zero and only the needle swinging position is changed in a predetermined sewing width for each of the stitches (FIG. 6C: Step S16).

Next, the stitching operation in the tacking section U3 is carried out. In the section U3, the operation control of the feeding step motor 48 is carried out in such a manner that the needle swinging amount is set to be zero and only the cloth feed is performed with a predetermined pitch in each of the stitches (Step S17).

The stitching operation in the tacking section U3 is carried out until it reaches the eyelet lower position P1 (the position having a distance of the inside diameter L2 of the annular section K1 from the origin point) in the forward direction of the cloth feeding. Then, the CPU 31 decides whether or not the seam has reached to a position several stitches to of the eyelet lower position P1 (the number of pitches is previously set) (Step S18). When the seam reaches the position several pitches to the eyelet lower position P1, the feeding step motor 48 is controlled to reduce the feeding pitch in a predetermined ratio (the ratio is previously set) (Step S19).

Furthermore, the CPU 31 decides whether or not the seam has reached to a position one pitch or less to the eyelet lower position P1 (a pitch reduced in a predetermined ratio) (Step S20). When the seam reaches the position one pitch or less to the eyelet lower position P1, then, the CPU 31 carries out a transition to the zigzag sewing operation (the ZZ sewing operation) in the right side stitching section K3 (FIG. 6D: Step S21).

More specifically, when the CPU 31 executes the processing of Step S21, the CPU 31 executes a control as "a switching control portion operable to decide, based on a detection of the feed detecting means (the position detecting device 24), whether a distance to a switching target position (the eyelet lower position P1), at which the sewing is switched from tacking sewing (the tacking section U3) to a zigzag sewing (the right side stitching section K3), is equal to or smaller than one pitch, and, when the distance is equal to or smaller than one pitch, to control the needle swinging motor (the needle swinging step motor 46) and the feeding motor (the feeding step motor 48) so as to switch to the zigzag sewing (the tacking section U3) before reaching at the switching target position (the eyelet lower position P1)".

In Step S21, in the same manner as in the left side stitching operation, the needle swinging step motor 46 and the feeding step motor 48 are driven based on the needle swinging amount and the pitch which are input from the setting volume 49 in order to execute the zigzag sewing operation (the ZZ sewing operation) in the right side stitching section K3.

When a bar tacking position (a position having the length L1 from the sewing starting position in the side stitching section K3 or a position having the buttonhole length L from the origin P0) is detected by the position detecting device 24 (Step S22), the sewing operation in the bar tacking section K4 is carried out. In the section K4, the operation control of the feeding step motor 48 and the needle swinging step motor 46 is carried out such that a needle is swung transversely and alternately every stitch with a predetermined needle swinging amount, and with the cloth feeding amount being a predetermined minute pitch (Step S23).

When the bar tacking operation is carried out in a predetermined number of stitches, a lock stitching is thereafter carried out. Then, all the motors 44, 46, 48 are stopped, and the eyelet buttonholing sewing is ended (Step S24).

Figure 9:
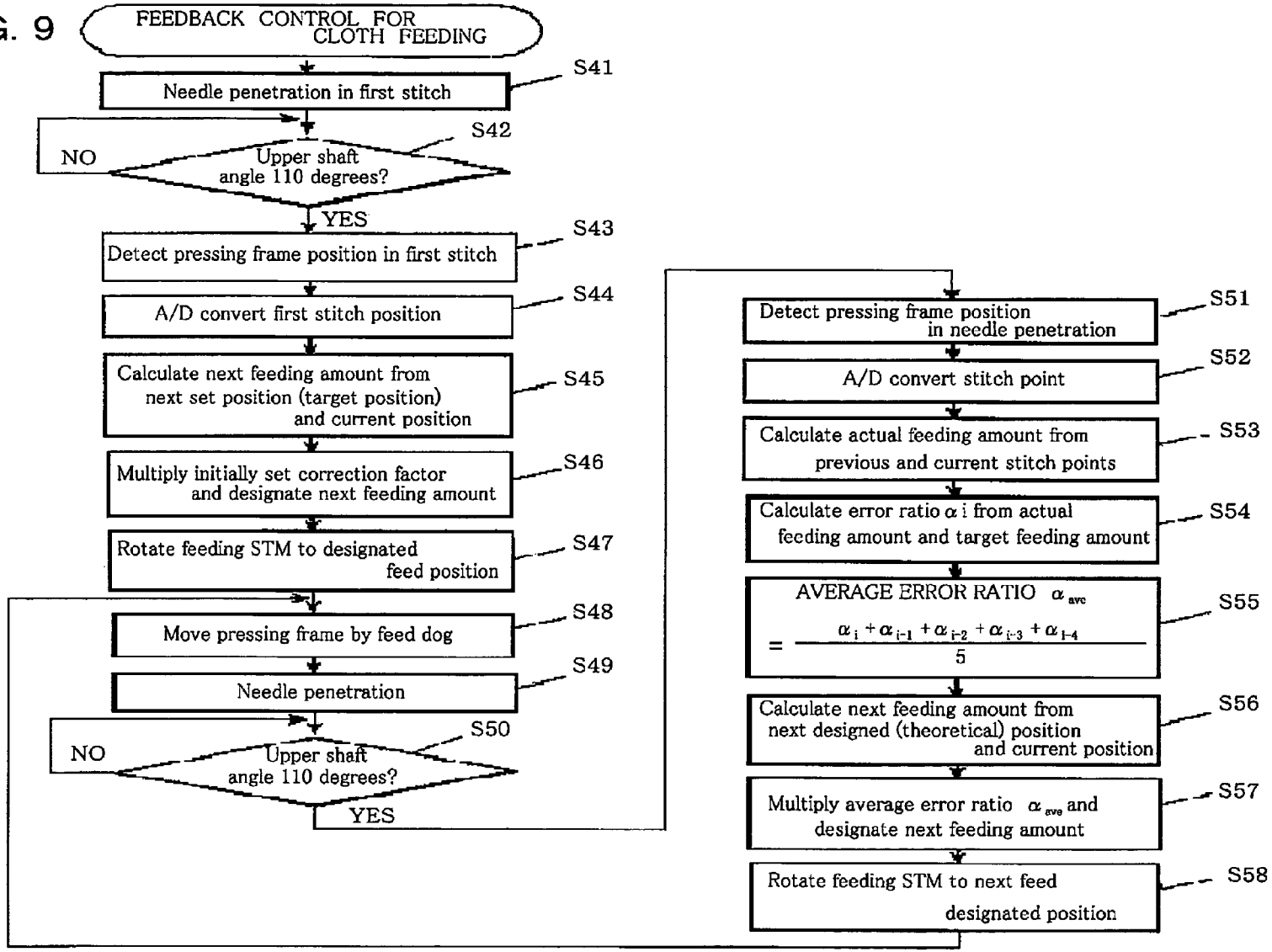
FIG. 9 is a flowchart showing a feedback control in the eyelet buttonholing.

Next, the feedback control for the cloth feeding to be executed in the stitching will be described with reference to FIG. 9. FIG. 9 is a flowchart showing the feedback control.

In the operation control of the buttonholing sewing, when the first stitch in the tacking section U1 is started by stitching the origin P0 (Step S41), and the encoder 50 detects an upper shaft angle of 110 degrees (Step S42), a position of the pressing frame 22 in the cloth feeding direction is detected by the position detecting device 24 (Step S43). The output of the position detecting device 24 is converted into a digital signal through the A/D converter 24*f*, and the digital signal is input to the control device 3 (Step S44).

Subsequently, a next target feeding amount is calculated (Step S45) from a difference in the cloth feeding direction between a target position of a second stitch and a current position (the detected position in the Step S43). Then, the target feeding amount is multiplied by an initial set correction factor (e.g., 1.0) to be a correction value which is previously registered in the memory 32 to calculate a feeding amount of a second stitch (Step S46).

Thereafter, the operation control is executed to drive the feeding step motor 48 to a predetermined designated position such that the feeding mechanism carries out the feed in the feeding amount thus calculated (Step S47).

After the feeding step motor 48 is driven, the feed dog 5 reaches the upper surface of the throat plate 4 and the pressing frame 22 is fed together with the cloth (Step S48).

Subsequently, the needle N reaches the cloth by a downward movement thereof (Step S49). If the encoder 50 detects the upper shaft angle of 110 degrees (Step S50), the position of the pressing frame 22 in the cloth feeding direction is detected by the position detecting device 24 (Step S51). The output of the position detecting device 24 is converted into a digital signal through the A/D converter 24*f*, and is input to the control device 3 (Step S52).

Next, an actual feeding amount is calculated from a difference between the detected position of the pressing frame in the previous stitch and the current position detected in Step S51 (Step S53).

Furthermore, the actual feeding amount is divided by the target feeding amount to calculate the error ratio $\alpha i$ (Step S54). The error ratio is stored in the memory 32.

Thereafter, the CPU 31 averages the error ratio $c\alpha i$ and previous error ratios $\alpha i$-1, $\alpha i$-2, $\alpha i$-3 and $\alpha i$-4 (a default value, e.g., 1.0, is employed for the error ratio which has not been stored because five error ratios are not stored until a sixth stitch from a sewing start) to calculate the average error ratio $\alpha ave$ (Step S55).

The CPU 31 stores the error ratios $\alpha i$ corresponding to the latest five stitches in the memory 32. When the error ratio is newly acquired, old data is deleted in order.

Although the error ratios corresponding to the five stitches are averaged, the number of samples of the error ratio $\alpha i$ may be increased or decreased if it is equal to or more than two. When the number of samples of the error ratio $\alpha i$ is less than five, it is also possible to use the error ratios which are stored instead of compensating with the default value.

Subsequently, a next target feeding amount is calculated from a difference between a target position in a next stitch point and the current position (the position detected in Step S51) in the cloth feeding direction. Then, the target feeding amount is multiplied by the average error ratio $\alpha ave$ (the correction value) to calculate a feeding amount in the subsequent stitch (Step S57).

Then, an operation control is executed to drive the feeding step motor 48 to a predetermined designated position such that the feeding mechanism carries out the feed in a calculated feeding amount (Step S58).

Thereafter, the processing returns to the Step S48. Subsequently, the processings of Steps S48 to S58 are repeated until all the stitches in the eyelet buttonholing sewing are ended.

In the sewing machine 10, the position in the cloth feeding direction corresponding to latest five stitches is detected, and the average error ratio $\alpha ave$ is obtained from the error amount in each stitch to correct the cloth feeding amount. Therefore, the cloth feeding amount is corrected in each of the stitches so that the generation of unstableness can be suppressed, resulting in an enhancement in sewing quality.

As compared with the case in which the feeding amount is corrected based on an error only in one stitch just before the current stitch, it is possible to avoid a correction in which the error is sensitively reflected. For example, it is possible to reduce the influence in a case in which a disturbance is accidentally generated on the feed in a previous stitch and an error is thus increased or the influence of an error made by a noise in a detection. Thus, it is possible to carry out a stable sewing operation.

In the sewing machine 10, moreover, the error is stored based on the detection of a plurality of stitches and the correction value (the average error ratio αave) is thus obtained. Therefore, the default value is substituted until the necessary number of stitches is carried out. Consequently, an accuracy of the correction may be deteriorated. However, as shown in FIG. 5, the eyelet sewing operation is started in the tacking section. Therefore, even if an instability of the feed and a nonuniformity of the pitch are generated, the zigzag sewing operation is carried out thereover so that they are hidden. Consequently, the sewing quality can be prevented from being deteriorated.

In the sewing machine 10, furthermore, in a case in which the distance to the eyelet lower position P1 to be the target position is equal to or smaller than one residual pitch in the sewing operation in the tacking section U3, the tacking operation is ended and a control for a transition to the sewing operation in the right side stitching section K3 is carried out. Consequently, it is possible to prevent a seam from being protruded from the eyelet lower position P1 and to prevent the tacking stitch from getting out of the range of the zigzag stitch. Thus, it is possible to enhance the sewing quality.

When the button B is held by the button holding device 23, moreover, the sliding portion 23*a* is moved corresponding to the outside diameter of the button B with respect to the fixed portion 23*b*. By detecting the moving amount of the sliding portion 23*a*, therefore, it is possible to obtain the outside diameter of the button B. Moreover, it is possible to use the detected button diameter for the sewing control and to eliminate the complicatedness of a work for inputting the button diameter. Thus, it is possible to enhance a workability of the sewing machine.

(Another Example of Feedback Control)

In the above exemplary embodiment, the correction of the cloth feeding amount is continuously executed irrespective of the sewing sections. However, in a case of carrying out such a sewing operation that the cloth feeding direction is substantially constant in each of the sewing sections, as in the buttonhole sewing operation, and the cloth feeding direction changes reversely when the section is switched, the storage of the feeding error for calculating the correction value may be carried out within each of the sections independently. Namely, when a stitching in a certain section is finished, the control device 3 may carry out the processing such that the correction value of the finished section is not referred anymore in a next section and an error is newly calculated from the beginning. For example, in a case in which a tendency of the error is different in the forward and reverse directions of the cloth feeding, and a fluctuation in the cloth feeding direction is generated with the switching of the section, it is possible to prevent the correction from being carried out by referring to the correction value in the opposite cloth feeding direction, thereby correcting the error more accurately. Thus, it is possible to enhance the sewing quality.

For the same reasons as described above, moreover, the control device 3 may carry out a processing for separately obtaining the correction values in the forward direction and the reverse direction and performing the correction with the correction value in the forward direction when executing the cloth feeding in the forward direction, and performing the correction with the correction value in the reverse direction when executing the cloth feeding in the reverse direction.

Figure 10:
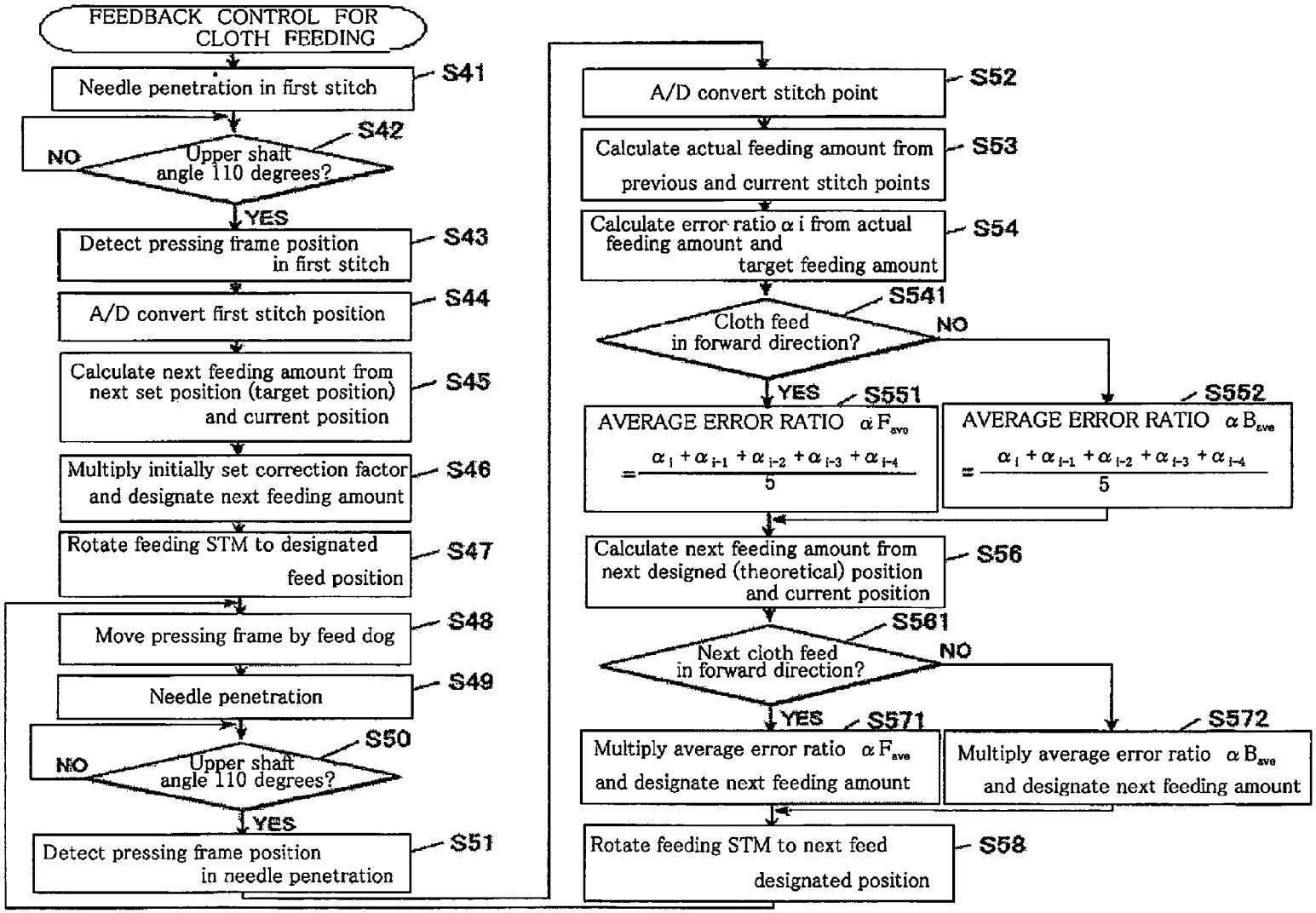
FIG. 10 is a flowchart showing another feedback control in the eyelet buttonholing.

Namely, the CPU 31 of the control device 3 may execute a feedback control shown in FIG. 10 in accordance with a processing program. Since the feedback control shown in FIG. 10 has many processings which are the same as the processings of the feedback control shown in FIG. 9, the common processings have the same step numbers and description will be omitted.

When the error ratio αi is calculated by the processing of Step S54 in stitches after the second stitch, the CPU 31 decides whether the cloth feed to a current stitch point is carried out in the forward direction or the reverse direction (Step S541). The decision may be carried out based on the target feeding amount or the detected feeding amount in Step S53.

If it is decided that the cloth feed to the current stitch point is carried out in the forward direction (Step S541: YES), the error ratio αi and the previous error ratios αi-1, αi-2, αi-3 and αi-4 are averaged to calculate an average error ratio αFave in the forward direction (Step S551).

If it is decided that the cloth feed to the current stitch point is carried out in the reverse direction (Step S541: NO), the error ratio αi and the previous error ratios αi-1, αi-2, αi-3 and αi-4 are averaged to calculate an average error ratio αBave in the rearward direction (Step S552).

The CPU 31 distinguishes the error ratio αi in the forward direction and the reverse direction and stores the error ratios αi corresponding to five stitches in the memory.

Subsequently, a next target feeding amount is calculated from a difference between a target position of a next stitch point and a current position in the cloth feeding direction (Step S56), and it is decided whether the next cloth feed is carried out in the forward direction or the reverse direction (Step S561).

If it is decided that the next cloth feed is carried out in the forward direction (Step S561: YES), the target feeding amount is multiplied by the average error ratio αFave to be the correction value, and a feeding amount in a next stitch is calculated (Step S571).

If it is decided that the next cloth feed is carried out in the reverse direction (Step S561: NO), the target feeding amount is multiplied by the average error ratio αBave to be the correction value and the feeding amount in the next stitch is calculated (Step S572).

Then, an operation control is executed to drive the feeding step motor 48 to a predetermined designated position such that the feeding mechanism carries out the feed in the feeding amount thus calculated (Step S58).

Thereafter, the processing returns to Step S48, and the stitching is carried out and by executing the correction by using respective correction values in each of the stitches in the forward and reverse feeding directions.

In the case in which the tendency of the error is varied in the forward and reverse directions of the cloth feed, consequently, it is possible to correct the error every stitch more accurately and to further enhance the sewing quality.

(Another Example of Position Detecting Device)

Figure 11:
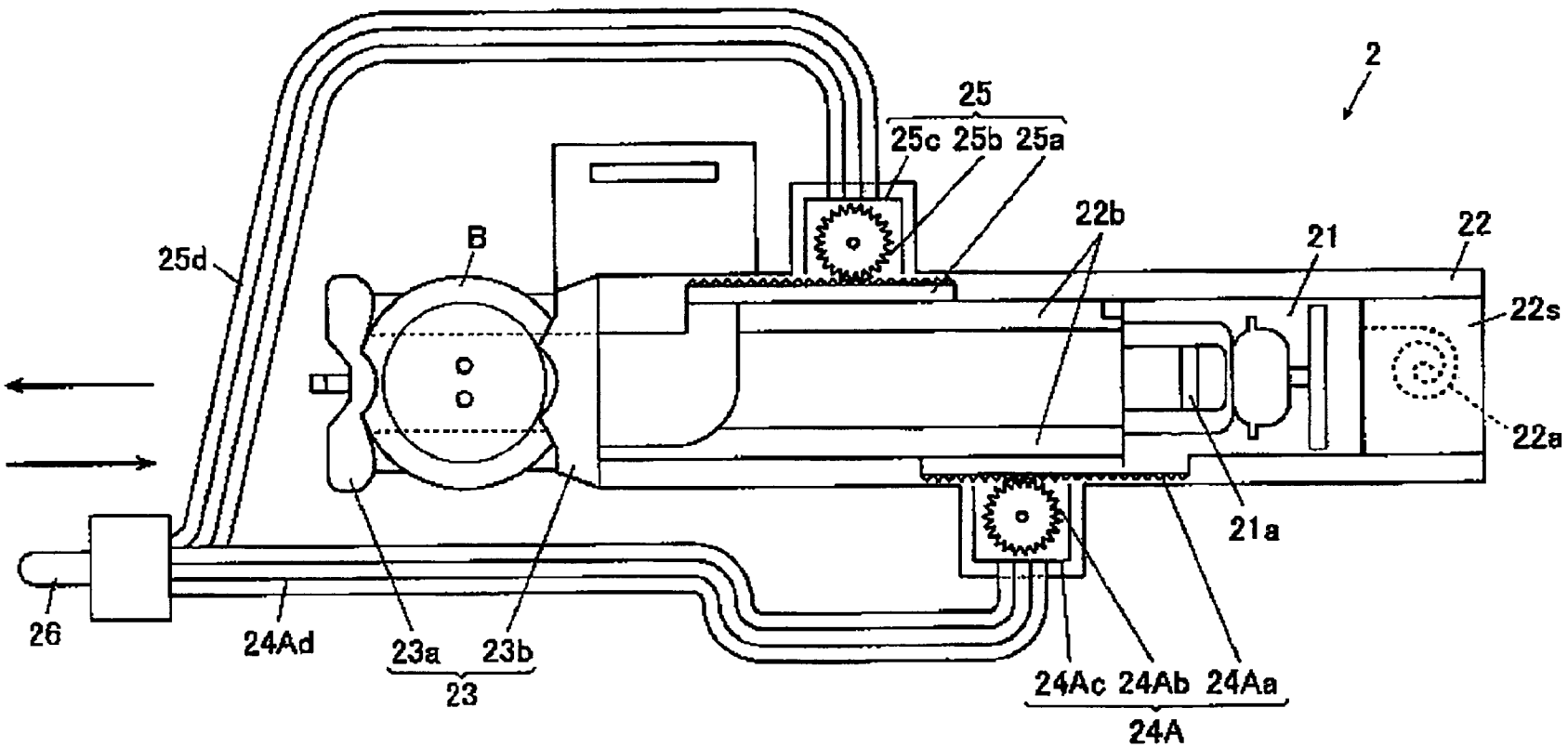
FIG. 11 is a schematic plan view of a buttonholing device having another position detecting device.

Although the position detecting device 24 uses the slide volume to detect the position of the pressing frame 22, it is not restricted to the structure. For example, as in a position detecting device 24A shown in FIG. 11, it is also possible to include a rack 24Aa fixed and provided onto the pressing member 21, a pinion 24Ab engaging with the rack 24Aa, a rotary potentiometer 24Ac supported on the pressing frame 22, and a lead wire 24Ad via which an output signal is sent from the potentiometer 24Ac to the control device 3.

The pinion 24Ab is provided on a rotating amount detecting shaft of the potentiometer 24Ac. When the pressing frame 22 is moved, the rotating amount detecting shaft of the potentiometer 24Ac is rotated through the rack 24Aa and the pinion 24Ab so that a detection signal corresponding to a moving amount of the pressing frame 22 can be output to the control device 3.

It is also possible to use a slide volume by the same structure as the position detecting device 24 in place of the potentiometer of the button diameter detecting device 25.

Figure 12:
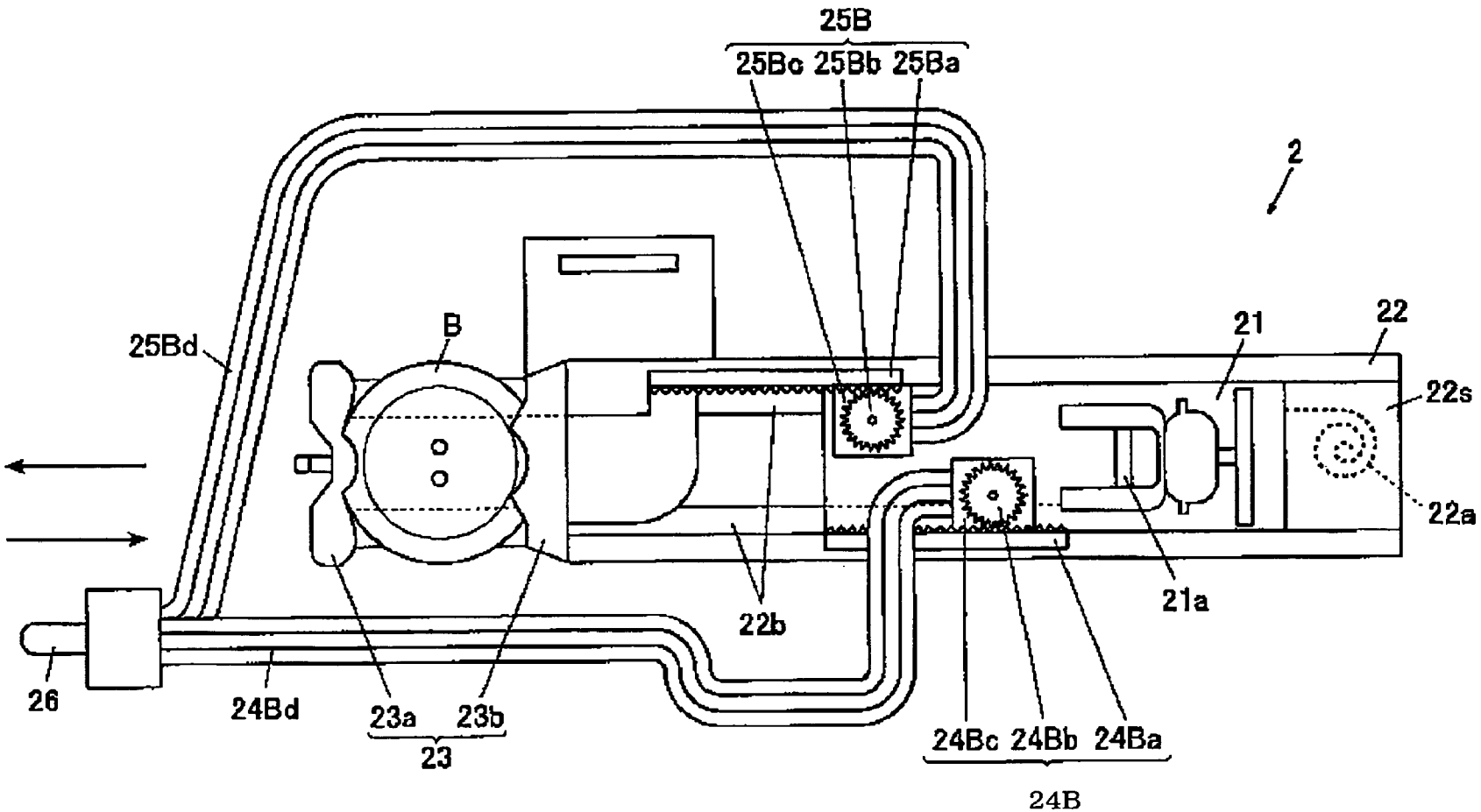
FIG. 12 is a schematic plan view of a buttonholing device having another position detecting device and another button holding device.
Figure 13A:
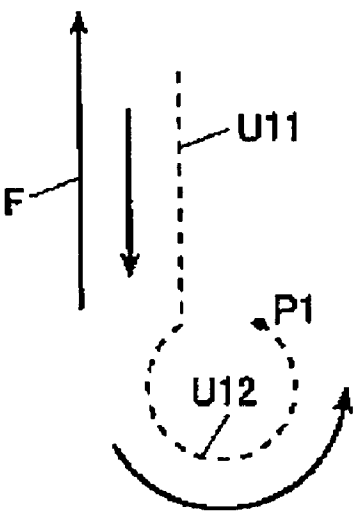
FIGS. 13A to 13D are explanatory views, each showing another process of an eyelet buttonholing in order.
Figure 13B:
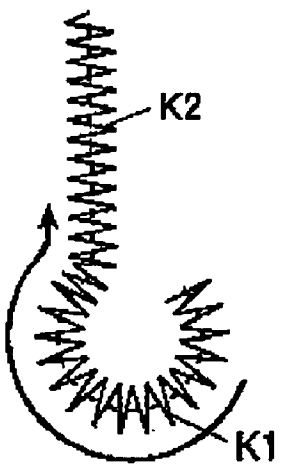
Figure 13C:
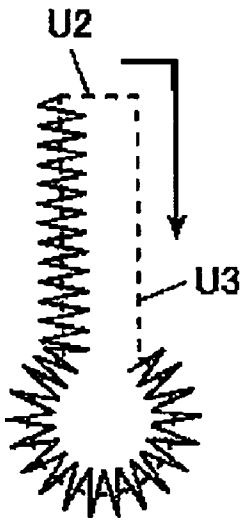
Figure 13D:
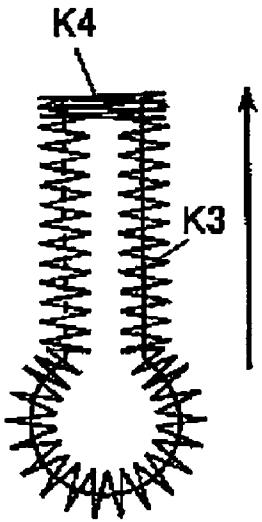
Figure 14A:
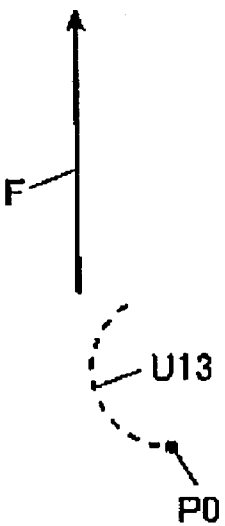
FIGS. 14A to 14E are explanatory views, each showing another process of an eyelet buttonholing in order.
Figure 14B:
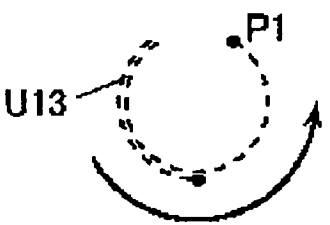
Figure 14C:
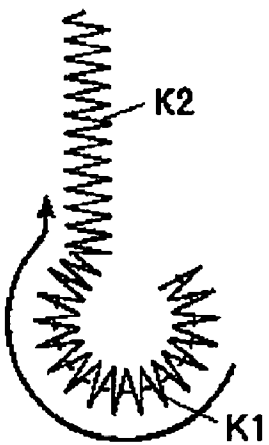
Figure 14D:
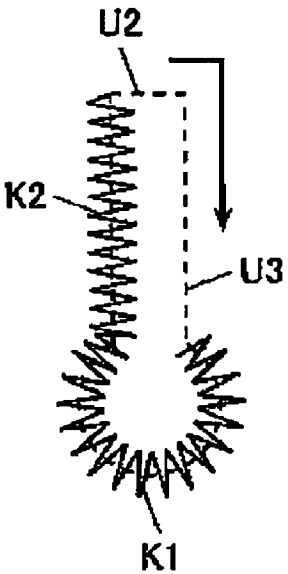
Figure 14E:
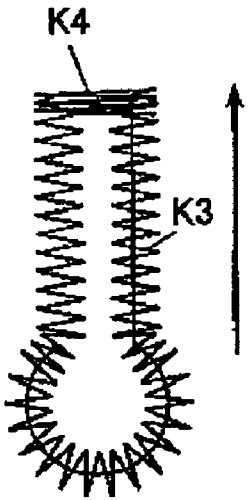
Figure 15A:
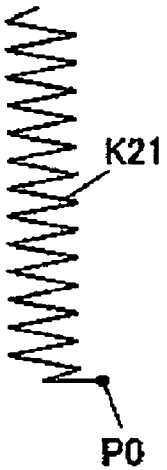
FIGS. 15A to 15E are explanatory views, each showing a process of a normal buttonholing in order.
Figure 15B:
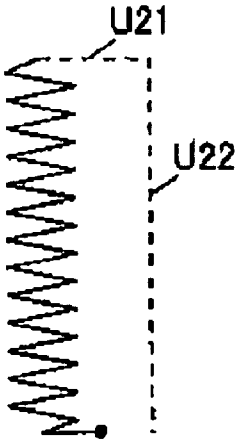
Figure 15C:
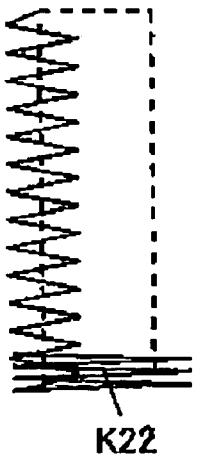
Figure 15D:
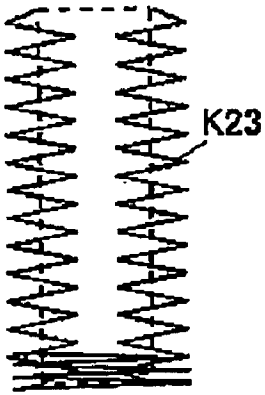
Figure 15E:
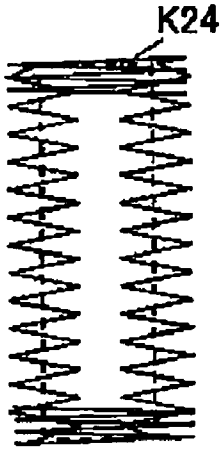
Figure 16:
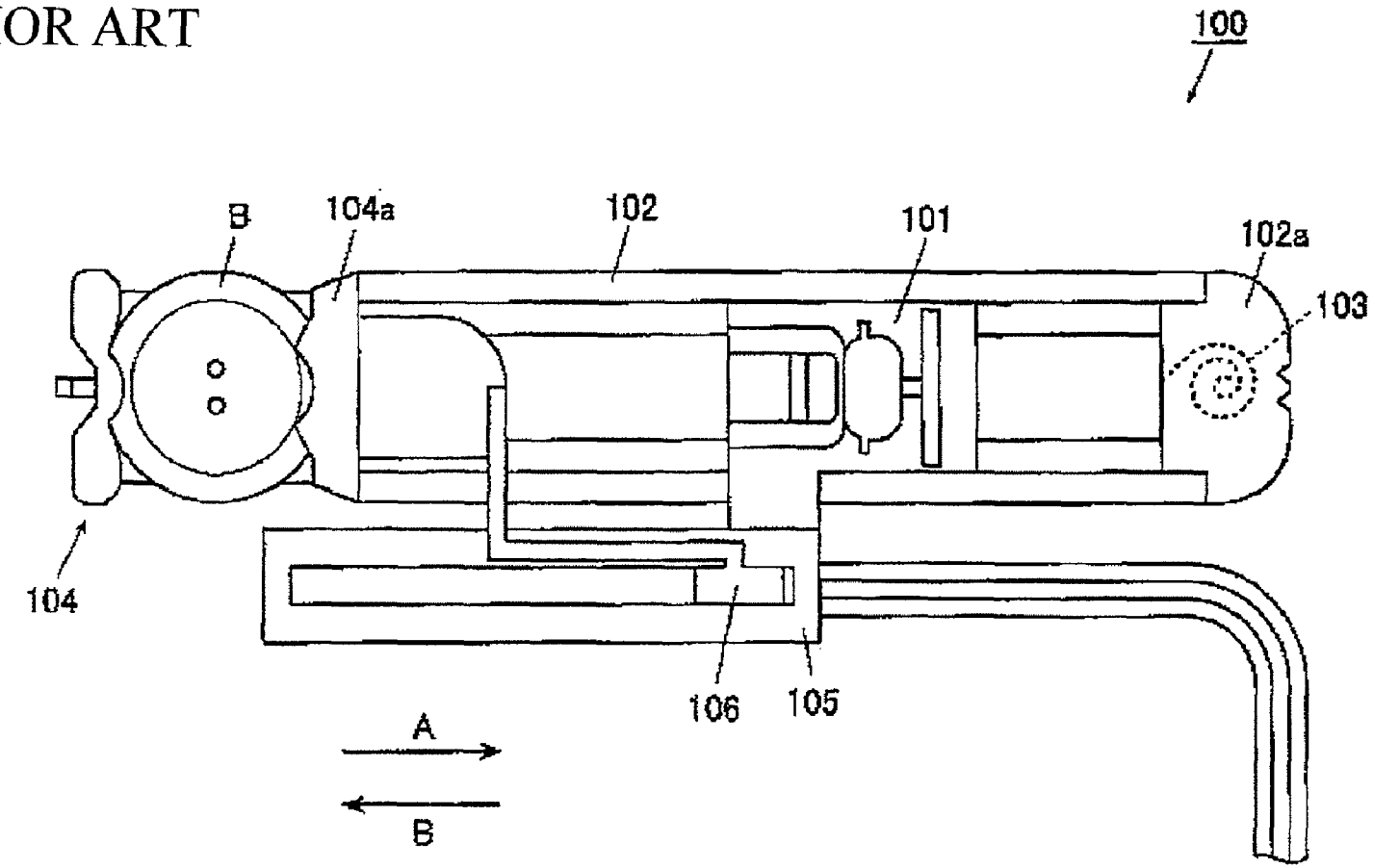
FIG. 16 PRIOR ART
FIG. 16 is a schematic plan view of a conventional buttonholing device.
Figure 17:
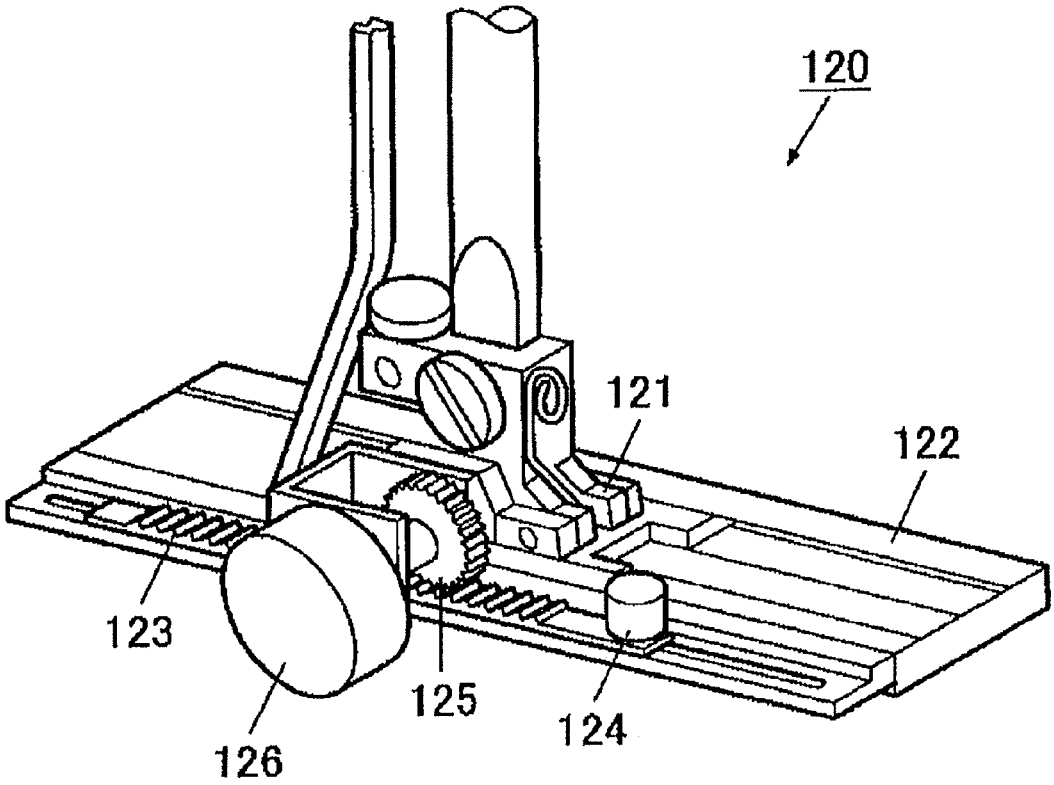
FIG. 17 PRIOR ART
FIG. 17 is a schematic perspective view of another conventional buttonholing device.

As in a position detecting device 24B shown in FIG. 12, it is also possible to have a rack 24Ba fixed and provided onto the pressing frame 22, a pinion 24Bb engaging with the rack 24Ba, a rotary potentiometer 24Bc supported on the pressing member 21, and a lead wire 24Bd via which an output signal is sent from the potentiometer 24Bc to the control device 3.

A detection signal corresponding to the moving amount of the pressing frame 22 is output to the control device 3 in the same manner as in the position detecting devices 24 and 24A.

Referring to a button diameter detecting device 25B, it is also possible to provide a rack 25Ba fixed and provided onto the sliding portion 23*a* of the button holding device 23, a pinion 25Bb engaging with the rack 25Ba, a rotary potentiometer 25Bc supported on the pressing member 21, and a lead wire 25Bd via which an output signal is sent from the potentiometer 25Bc to the control device 3.

The pinion 24Bb is provided on a rotating amount detecting shaft of the potentiometer 24Bc. When the pressing frame 22 is moved, the rotating amount detecting shaft of the potentiometer 24Bc is rotated through the rack 24Ba and the pinion 24Bb so that a detection signal corresponding to a moving amount of the pressing frame 22 can be output to the control device 3.

Moreover, the pinion 25Bb is provided on a rotating amount detecting shaft of the potentiometer 25Bc. When the sliding portion 23*a* is moved, the rotating amount detecting shaft of the potentiometer 25Bc is rotated through the rack 25Ba and the pinion 25Bb so that a detection signal corresponding to an outside diameter of the button can be output to the control device 3.

(Another Example of Sewing Operation)

The eyelet buttonholing steps of the sewing machine 10 are not restricted to the foregoing example. For example, as shown in FIGS. 13A to 13D, it is also possible to start a sewing operation at an end on a bar tacking side. In this case, a tacking section U11 in which a sewing operation is carried out straight in the reverse direction to the cloth feed in a sewing start position, and a tacking section U12 in which an arcuate sewing operation is carried out to move the cloth to a first stitch position of the annular section K1 within the same range as the annular section K1, are provided in place of the tacking section U1.

In the tacking section U11, a sewing length thereof is obtained in the same manner as in the tacking section U3. In the tacking section U12, the sewing operation is carried out in accordance with pattern data in which all of positions and needle swinging amounts in the cloth feeding direction are predetermined in order every stitch and a plurality of pattern data for different diameters are prepared in the memory 32. When the pattern data in the annular section K1 for a suitable diameter are selected corresponding to the buttonhole length L, the pattern data in the tacking section U12 corresponding thereto are selected at the same time.

The other sections are the same as those in the sewing steps shown in FIGS. 6A to 6E.

As shown in FIGS. 14A to 14E, moreover, it is also possible to start the sewing operation in the sewing start position P0, and to provide a tacking section U13 in which an arcuate sewing operation is carried out in the reverse direction to the tacking section U1, and a tacking section U14 in which an arcuate sewing operation for moving the cloth to a first stitch position of the annular section K1 within the same range as the annular section K1 in place of the tacking section U1.

In both the tacking sections U13 and U14, the sewing operation is carried out in accordance with pattern data in which all of positions and needle swinging amounts in the cloth feeding direction are predetermined in order every stitch, and a plurality of pattern data for different diameters are prepared in the memory 32. When the pattern data in the annular section K1 for a suitable diameter are selected corresponding to the buttonhole length L, pattern data in the tacking sections U13 and U14 corresponding thereto are selected respectively at the same time.

Referring to the other sections, the same sewing steps as those in FIGS. 6A to 6E are carried out.

In the case in which the eyelet buttonholing sewing is carried out in these steps, the number of stitches in the tacking operation to be carried out prior to the zigzag sewing operation can be maintained to be larger than that in the case of FIGS. 6A to 6E. Therefore, it is possible to sufficiently detect an error before the zigzag sewing operation is started.

Moreover, a normal buttonholing sewing may be carried out in addition to the eyelet buttonholing sewing. FIGS. 15A to 15E are explanatory views showing a process for the normal buttonholing sewing.

As shown in FIGS. 15A to 15E, the buttonholing sewing is executed in order of a left side stitching section K21, a tacking section U21, a tacking section U22, a bar tacking section K22, a right side stitching section K23 and a bar tacking section K24 by setting the sewing start position to be P0.

In the left side stitching section K21 and the right side stitching section K23, a zigzag sewing operation is carried out in the reverse feeding direction F while swinging the needle, and the cloth is fed in the forward direction at a certain pitch in each of the stitches, and at the same time, the needle swinging direction is alternately switched in a certain needle swinging width in each of the stitches to carry out a sewing operation. The pitch and the needle swinging width are set by previously inputting numeric values from the setting switch 49. Moreover, the sewing length L1 of the left side stitching section K2 and the right side stitching section K3 is set corresponding to the buttonhole length L determined based on the button diameter detected by the button diameter detecting device 25 (e.g., L+2 mm).

In the tacking section U21, a sewing operation is carried out straight in a transverse direction from a final stitch position of the left side stitching section K21 to a first stitch position of the tacking section U22, and a sewing length thereof corresponds to needle swinging lengths of the bar tacking sections K22 and K24 which will be described below, and is calculated simultaneously with the calculation of the needle swinging lengths.

In the tacking section U22, the sewing operation is carried out straight in the forward direction of the cloth feed from the final stitch position of the tacking section U21 to the same cloth feeding position as the sewing start position P0, and a sewing length thereof is calculated simultaneously with the calculation of the sewing lengths of the side sewing sections K21 and K23 because it is equal to the sewing lengths of the side sewing sections K21 and K23.

In the bar tacking sections K22 and K24, the sewing operation is carried out through a needle swing at plural times across both of the left and right side stitching sections K21 and K23 at both ends of the side sewing sections K21 and K23. The needle swinging width is calculated by the CPU 31 through a calculation for setting the needle swinging width to be a little more than a double of the needle swinging widths of the side sewing sections K21 and K23 when they are set and input.

For the normal buttonholing sewing, similarly, the feedback control for correcting the feeding amount is executed.

In the exemplary embodiments, the control of the switching control portion for switching into the zigzag sewing operation in a case in which the distance to the target position is equal to or smaller than one residual pitch is executed only in the switching target position from the tacking section U3 to the right side stitching section K3. In the switching for the other sections, similarly, it is also possible to execute the switching control.

While the buttonholing sewing by the sewing machine 10 has been mainly described above, a sewing machine to which the present invention is applied is not restricted to the buttonholing machine. The correcting control according to the present invention can also be applied to any sewing machines which include a pressing member provided on a lower end of a pressing bar, and a pressing frame supported movably in a cloth feeding direction by the pressing member and holds a cloth.

What is claimed is:

1. A control device of a sewing machine comprising:

a pressing member which is detachably attached to a lower end of a pressing bar of the sewing machine;

a pressing frame which is supported by the pressing member so as to be movable in a cloth feeding direction of a workpiece and which holds the workpiece;

feed detecting means for detecting a position or a feeding amount of the pressing frame in the cloth feeding direction with respect to the pressing member;

a feed dog which feeds the workpiece in the cloth feeding direction every stitch in association with the pressing frame;

a feeding motor which sets a cloth feeding amount of the feed dog;

a storing portion which stores, in every stitch, an error between a target position or a target feeding amount of the pressing frame in the cloth feeding direction and a detected position or a detected feeding amount obtained by the feed detecting means; and control means operable, in every stitch, to determine a correction value from the errors in a plurality of stitches which are stored immediately before, and to control the feeding motor to drive with the cloth feeding amount corrected by the correction value.

2. The control device according to claim 1, wherein the control means is further operable to obtain the correction value separately in a forward feeding direction and a reverse feeding direction, wherein the control means controls the feeding motor, in every stitch, based on the correction value in the forward feeding direction when the cloth feeding is carried out in the forward feeding direction, and based on the correction value in the reverse feeding direction when the cloth feeding is carried out in the reverse feeding direction.

3. A control device of a sewing machine, in which a sewing is carried out in accordance with sewing data including a combination of a tacking sewing for forming a seam in a form of a line with a certain pitch and a zigzag sewing for forming a seam swinging over alternately, comprising:

a needle swinging motor which swings a needle in a direction orthogonal to a cloth feeding direction;

a pressing member which is detachably attached to a lower end of a pressing bar of the sewing machine;

a pressing frame which is supported by the pressing member so as to be movable in the cloth feeding direction of a workpiece and which holds the workpiece;

feed detecting means for detecting a position or a feeding amount of the pressing frame in the cloth feeding direction with respect to the pressing member;

a feed dog which feeds the workpiece in the cloth feeding direction every stitch in association with the pressing frame;

a feeding motor which sets a cloth feeding amount of the feed dog;

a storing portion which stores, in every stitch, an error between a target position or a target feeding amount of the pressing frame in the cloth feeding direction and a detected position or a detected feeding amount obtained by the feed detecting means;

control means operable, in every stitch, to determine a correction value from the errors in a plurality of stitches which are stored immediately before, and to control the feeding motor to drive with the cloth feeding amount corrected by the correction value; and a switching control portion operable to determine whether or not a distance to a target position, at which a sewing is switched from the tacking sewing to the zigzag sewing, is equal to or smaller than one pitch in accordance with a detection of the feed detecting means, wherein if the distance is equal to or smaller than the one pitch, the switching control portion controls the needle before reaching at the switching target position.

4. The control device according to claim 3, wherein the control means is further operable to obtain the correction value separately in a forward feeding direction and a reverse feeding direction, wherein the control means controls the feeding motor, in every stitch, based on the correction value in the forward feeding direction when the cloth feeding is carried out in the forward feeding direction, and based on the correction value in the reverse feeding direction when the cloth feeding is carried out in the reverse feeding direction.

* * * * *